US011109676B2

(12) United States Patent
Bantle et al.

(10) Patent No.: US 11,109,676 B2
(45) Date of Patent: Sep. 7, 2021

(54) MOVEMENT DEVICE FOR DRAWERS

(71) Applicant: Karl Simon GmbH & Co. KG, Aichhalden (DE)

(72) Inventors: Ulrich Bantle, Empfingen (DE); Jürgen Eschle, Alpirsbach-Reutin (DE)

(73) Assignee: Karl Simon GmbH & Co. KG

( * ) Notice: Subject to any disclaimer, the term of this patent is extended or adjusted under 35 U.S.C. 154(b) by 0 days.

(21) Appl. No.: 15/763,580

(22) PCT Filed: Jul. 18, 2016

(86) PCT No.: PCT/EP2016/067008
§ 371 (c)(1),
(2) Date: Sep. 17, 2018

(87) PCT Pub. No.: WO2017/059974
PCT Pub. Date: Apr. 13, 2017

(65) Prior Publication Data

US 2019/0021494 A1 Jan. 24, 2019

(30) Foreign Application Priority Data

Oct. 6, 2015 (DE) ..... 10 2015 117 004.3

(51) Int. Cl.
*A47B 88/463* (2017.01)
*A47B 88/47* (2017.01)

(52) U.S. Cl.
CPC ..... *A47B 88/47* (2017.01); *A47B 88/463* (2017.01)

(58) Field of Classification Search
CPC ..... E05F 1/16; E05F 5/003; A47B 88/0477; A47B 88/463; A47B 88/47; A47B 88/467; A47B 2210/0094
See application file for complete search history.

(56) References Cited

U.S. PATENT DOCUMENTS 7,533,946 B2 * 5/2009 Hoffman ..... A47B 88/467 312/319.1
7,854,485 B2 * 12/2010 Berger ..... A47B 88/47 312/333

(Continued)

FOREIGN PATENT DOCUMENTS

DE 202006020236 U1 3/2008
DE 102011050605 A1 11/2012

(Continued)

OTHER PUBLICATIONS

English translation EP2279680 (Year: 2011).*

*Primary Examiner* — Hiwot E Tefera
(74) *Attorney, Agent, or Firm* — Lucian Wayne Beavers; Patterson Intellectual Property Law, PC

(57) ABSTRACT

The invention relates to a movement device for drawers, including an extending mechanism. A blocking element can be moved from a retracted position into an open position or a partially open position by the extending mechanism, and the extending mechanism is held in the retracted position by an overstroke mechanism. The overstroke mechanism has a switching element which is held on a stop by a blocking element in the retracted position and can be lifted from the stop when an overstroke is applied onto the switching element. An improved switching behavior can be achieved in that the blocking element is offset transversely to the overstroke direction when the overstroke is applied.

15 Claims, 20 Drawing Sheets

(56) References Cited

U.S. PATENT DOCUMENTS

Figure 1:
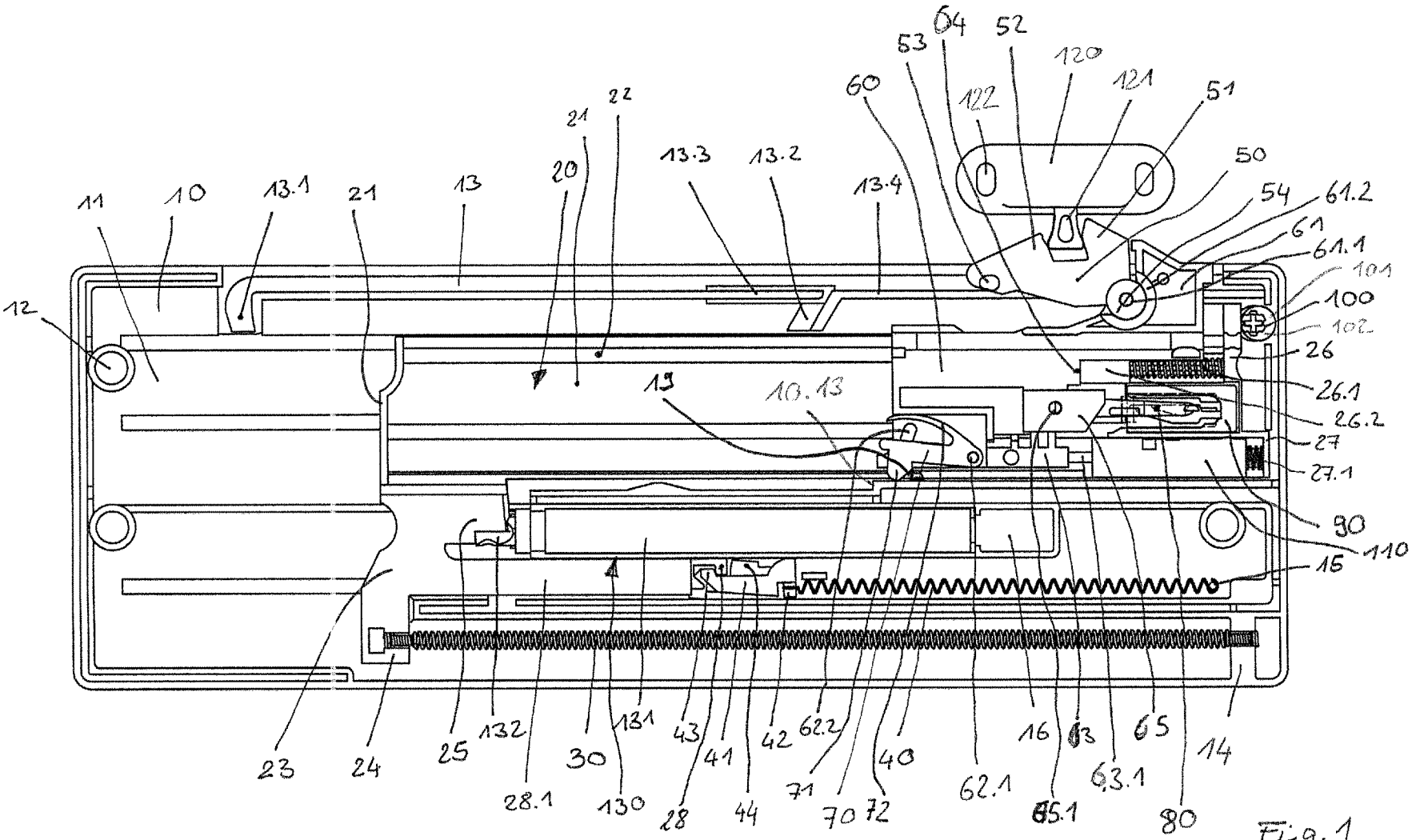

| | | | | |
|---|---|---|---|---|
| 9,657,506 | B2 | 5/2017 | Bantle | |
| 9,750,347 | B2 * | 9/2017 | Nuckolls | A47B 88/463 |
| 9,775,434 | B2 | 10/2017 | Flogaus | |
| 2006/0113169 | A1 * | 6/2006 | Leon | A47B 88/467 200/5 R |
| 2007/0090735 | A1 * | 4/2007 | Hashemi | A47B 88/463 312/334.46 |
| 2007/0103041 | A1 | 5/2007 | Kropf et al. | |
| 2010/0026152 | A1 * | 2/2010 | Huang | A47B 88/467 312/319.1 |
| 2012/0001441 | A1 * | 1/2012 | Juan | A47B 88/463 292/164 |
| 2012/0319412 | A1 * | 12/2012 | Liang | E05B 65/46 292/340 |
| 2013/0134852 | A1 * | 5/2013 | Salice | A47B 88/47 312/319.1 |
| 2013/0287324 | A1 * | 10/2013 | Nuckolls | A47B 88/463 384/18 |
| 2014/0021841 | A1 * | 1/2014 | Brunnmayr | A47B 88/463 312/319.1 |
| 2014/0327351 | A1 * | 11/2014 | Chung | A47B 88/463 312/333 |
| 2015/0091424 | A1 * | 4/2015 | Nuckolls | A47B 88/433 312/319.1 |
| 2015/0097473 | A1 * | 4/2015 | Brunnmayr | A47B 88/47 312/319.1 |
| 2016/0076288 | A1 * | 3/2016 | Bantle | E05F 1/16 49/417 |

FOREIGN PATENT DOCUMENTS

| | | | |
|---|---|---|---|
| DE | 102013104886 | A1 | 11/2014 |
| EP | 2279680 | A1 | 2/2011 |
| WO | 2013073489 | A1 | 5/2013 |
| WO | 2013096980 | A1 | 7/2013 |

* cited by examiner

MOVEMENT DEVICE FOR DRAWERS

A movement device for drawers having a sliding-open mechanism, wherein by means of the sliding-open mechanism a blocking element is movable from a closed position into an open position or a part-open position, wherein the sliding-open mechanism is held in the closed position by means of an overstroke mechanism, wherein the overstroke mechanism comprises a switching element which is held on a stop in the closed position by way of a blocking member and, when an overstroke is applied to the switching element, is liftable from said switching element in a first switching movement.

Movement devices for drawers serve to simplify the operation of drawers. In this case, once an overstroke is applied, the drawer can the drawer can be moved from a closed position into an open position or a part-open position. As a rule, in this case, a locking system is released once the overstroke has been applied. An energy storing means, for example a prestressed spring, can then be relieved, the spring force being output to the drawer. The drawer can then be gripped and adjusted into an open position. In this way, it is possible to develop, in particular, drawer designs which manage without a drawer handle. The drawer is able to be unlocked and opened simply by applying pressure manually onto the panel of the drawer.

In particular, in the case of wide drawer panels, there is the problem of the pressure having to be exerted as much as possible in the region of the panel in which the movement device is also mounted. If, for example, a movement device is mounted on the left-hand side, it is advisable to exert the pressure there too. If the right-hand side of the panel is pressed, there is the problem of the movement device not being triggered from time to time. The decision has consequently been made to mount movement devices on both sides of the drawer. Solutions also exist where a movement device is used which is then synchronized with both sides of the drawer. In this case, costly mechanisms are installed on the underside of the drawer.

It is the object of the invention then to provide a movement device which is also triggered reliably in particular in the case of wide drawer fronts.

Said object is achieved in that when the overstroke is applied, the blocking member is offset transversely to the first switching movement, in particular transversely to the overstroke direction.

In addition to the triggering direction used in the prior art, which usually extends in the opposite direction to the opening direction of the drawer, according to the invention an additional movement direction of the blocking member is superimposed, namely, for example, transversely to the overstroke direction. In this way, the necessary switching path for unlocking the blocking member is able to be significantly reduced. The achievement here is that the movement device is triggered even in the case of small stroke paths. Even when, in the case of wide drawer fronts, a movement device is only installed on one side, it is nevertheless able to be reliably switched, even if the pressure is applied on the side of the panel located opposite the mounting position. In this way, expenditure on parts and assembly is also able to be reduced significantly. It is obviously also possible within the framework of the invention to mount movement devices on both sides of the drawer if, for example, particularly heavy drawers are to be moved.

According to an advantageous design variant of the invention, it can be provided that the path of the first switching movement is less than or equal to 1 mm. The drawer is then released just after the first switching movement is overcome simply by the blocking member being switched transversely to the first switching movement. Said switching progression enables reliable triggering of the movement device, in particular in the case of all drawer widths.

According to a preferred design variant of the invention, it is provided that a shoulder, into which the blocking member is deflected and is not engaged with the stop, connects to the stop. A clear switching position for the blocking member is achieved with the shoulder and the blocking member is prevented from being inadvertently able to pass back into the blocking position again.

In this connection, it can be provided, in particular, that a deflection bevel is provided which interacts with a deflection part of the switching element, and that the switching element deflected into the shoulder is deflectable with the deflection bevel transversely to the overstroke direction into a return region. When an overstroke is applied, the switching element switches into the shoulder and moves into contact with the deflection bevel. It is consequently forcibly adjusted in the shoulder such that the switching element is able to deflect in a targeted manner into the return region. In this way, the switching element is adjusted in a defined manner. Following the return region, the switching element, for example in the case of an invention variant, is then able to be moved out of the locking system in a targeted manner in order to be able to open the drawer.

So that in reverse when closing the drawer the switching element is able to be moved in a targeted manner into its locking position, it is provided according to an invention variant that a guide track is provided which comprises a deflection bevel, and in that the deflection part interacts with the deflection bevel in order to move the switching element into the region of the stop.

A simple design is produced as a result of the stop being part of a switching module which forms a cavity into which the switching element is introducible through a lead-in region.

A particularly reliable method of operation is ensured when it is provided that the switching lever is held in a spring-prestressed manner on the stop, and that when the blocking member transfers from the closed position into the offset position, the prestressing is reduced or removed.

In this case, it can be provided, in particular, that the switching element comprises a deflection portion which is adjusted at a counter element when the switching element moves in order to move the switching element into the prestressing position. When the switching element moves into the locking position, the prestressing is built up. Said operation is consequently integrated into the normal movement progression without additional measures having to be taken.

The switching element can be pivotably mounted on a pivot bearing so that it is able to be moved reliably between the individual switching and adjusting positions. A particularly preferred invention variant is such that the overstroke mechanism couples the sliding-open mechanism with a closing mechanism. In this way, a movement device is created with which the drawer is not just simply able to be moved automatically from the closed position into the open position. Rather, in this connection, it is also possible to close the drawer automatically from the open position or the part-open position into the closed position. It can be provided in particular, in this case, that an energy storing means, for example a closing spring, is relieved to realize said closing movement. In addition, it can be provided in an advantageous manner that the closing movement is damped by way of a damper.

A conceivable invention alternative is such that the switching element is held on an actuating member which is held prestressed in the closed position directly or indirectly against an energy storing means. The energy storing means can be used, for example, for sliding out the drawer.

To simplify the structural design further, it can be provided that the switching module is coupled directly or indirectly with the closing mechanism.

The object of the invention is also achieved with a method for moving a drawer out of a closed position into an open position or a part-open position, wherein a blocking element is movable by means of a sliding-open mechanism, wherein the sliding-open mechanism is held in the closed position by means of an overstroke mechanism, wherein a switching element abuts against a stop in order to hold the switching element in the closed position, and wherein when an overstroke is applied, the switching element is lifted from the stop. It is provided according to the invention in this case that when the overstroke is applied, the blocking member is offset transversely to the overstroke direction.

The invention additionally relates to a movement device for furniture parts, in particular drawers having a sliding-open mechanism and/or a closing mechanism, wherein a blocking element is provided which is realized in order to receive an entrainment means which is arranged on the associated furniture part, for example furniture carcass. So that the drawer front is able to be aligned precisely in its assignment to the furniture carcass, it can be provided according to the invention that an adjustment element is provided, by means of which the position of the closing mechanism or sliding-open mechanism is adjustable in the closed position in order to adjust the blocking element in its guiding direction or in opposition to its guiding direction.

Within the framework of the invention, a movement device can also be provided for drawers having a sliding-open mechanism, wherein by means of the sliding-open mechanism an actuating member is movable from a closed position into an open position or a part-open position, wherein the actuating member is held against the prestressing of an energy storing means in the closed position. It can be provided in this case according to the invention that the prestressing of the energy storing means is amendable in the closed position by means of an adjustment device.

In this way, the movement device can be adjusted to various drawer weights. In the case of a lighter drawer, the prestressing can be reduced and in the case of a heavy drawer it can be increased. In this case, it can be provided according to the invention that for light drawers the prestressing force is at least 5 N. If the prestressing is lower, light drawers are not accelerated sufficiently. It is also conceivable that in the case of heavy drawers the maximum spring force is 30 N. It has been shown that the triggering force becomes too high where the prestressing is greater and the overstroke mechanism is only able to be triggered using an uncomfortably high level of force.

Within the framework of the invention or as an independent inventive concept, it can also be provided that the sliding-out mechanism is constructed in such a manner that the energy storing means used, for example the spring, is not fully relieved. Rather, the relieving of the energy storing means can be stopped during the movement of the drawer. In this connection, use is made of the knowledge that small forces (for example of less than 3 N) no longer accelerate the drawer or only accelerate it a little. No more energy must have to be expended, however, to load the spring up to said force when pushing the drawer closed. This has the further advantage that the necessary energy to load the energy storing means is reduced. This is advantageous in particular in the case of slow-closing drawers when only a small amount of movement energy is provided to load the energy storing means.

Figure 2:
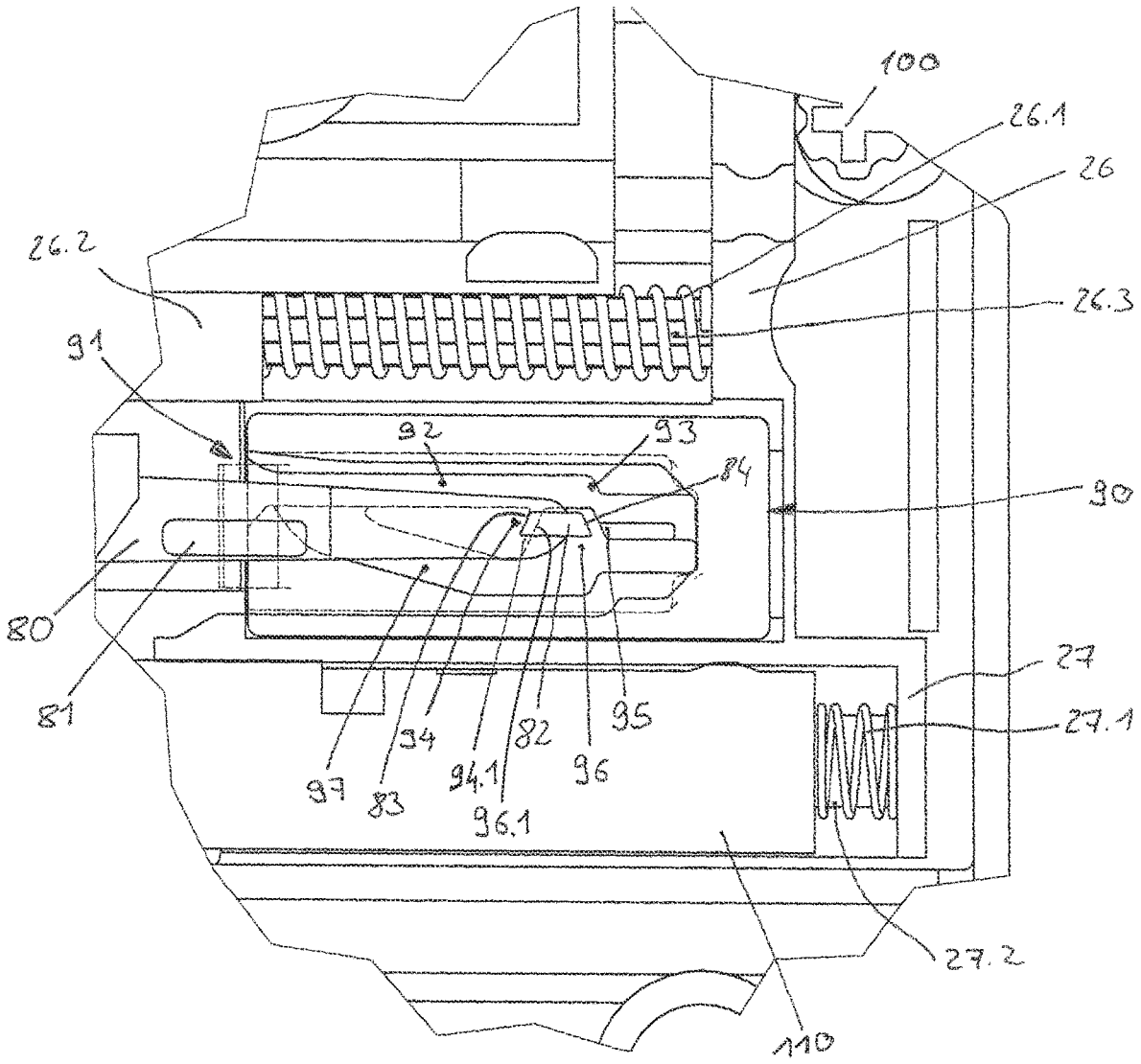
Figure 3:
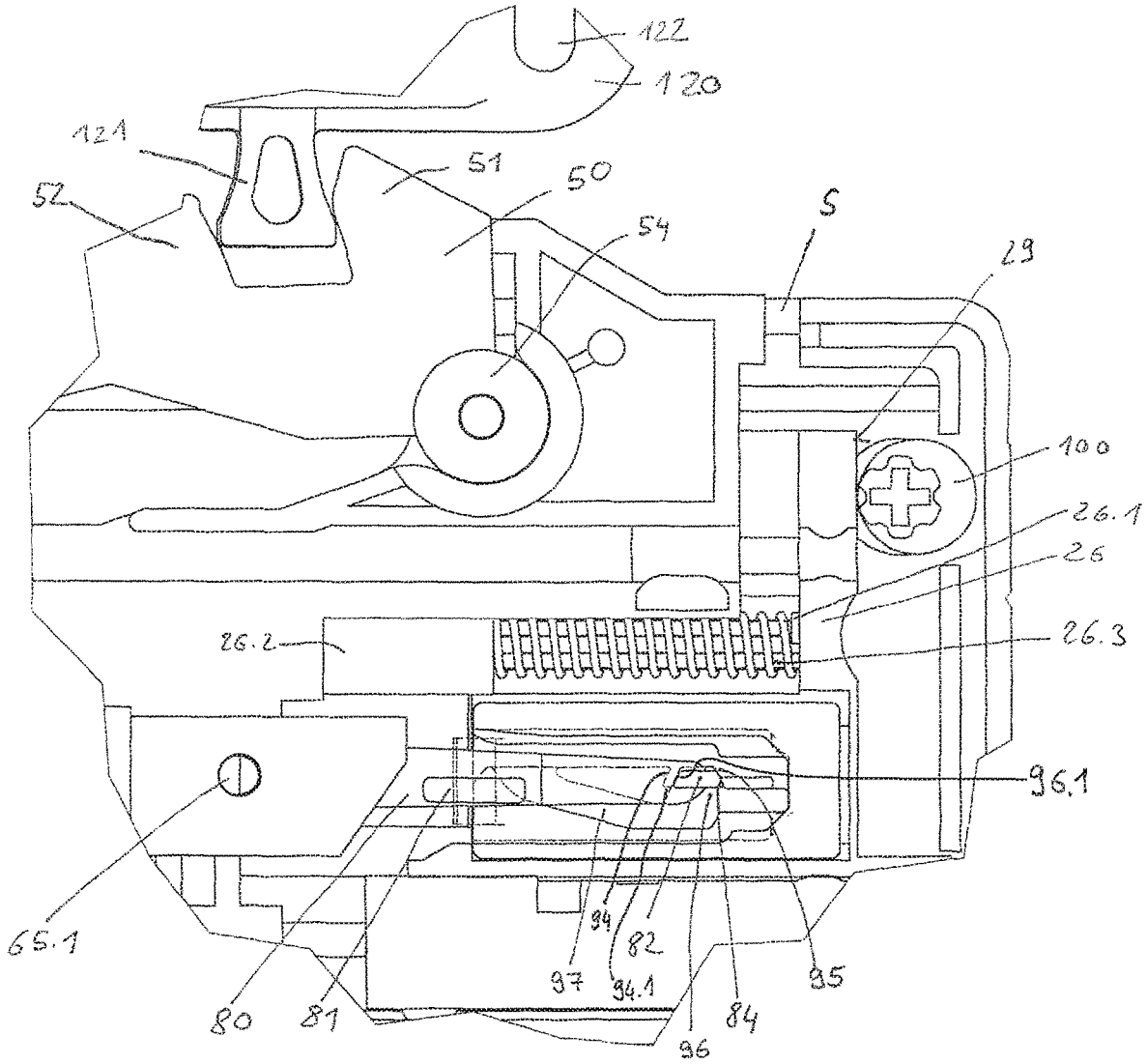
Figure 4:
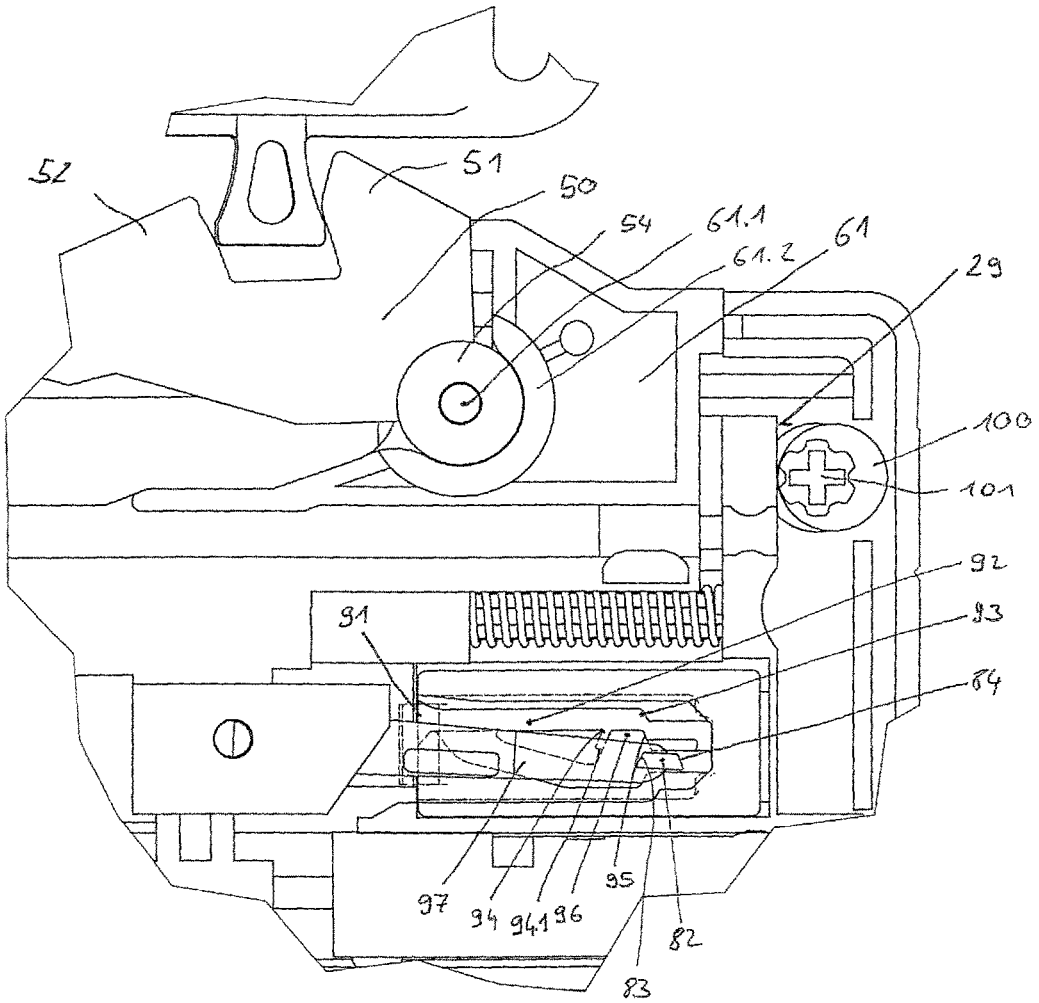
Figure 7:
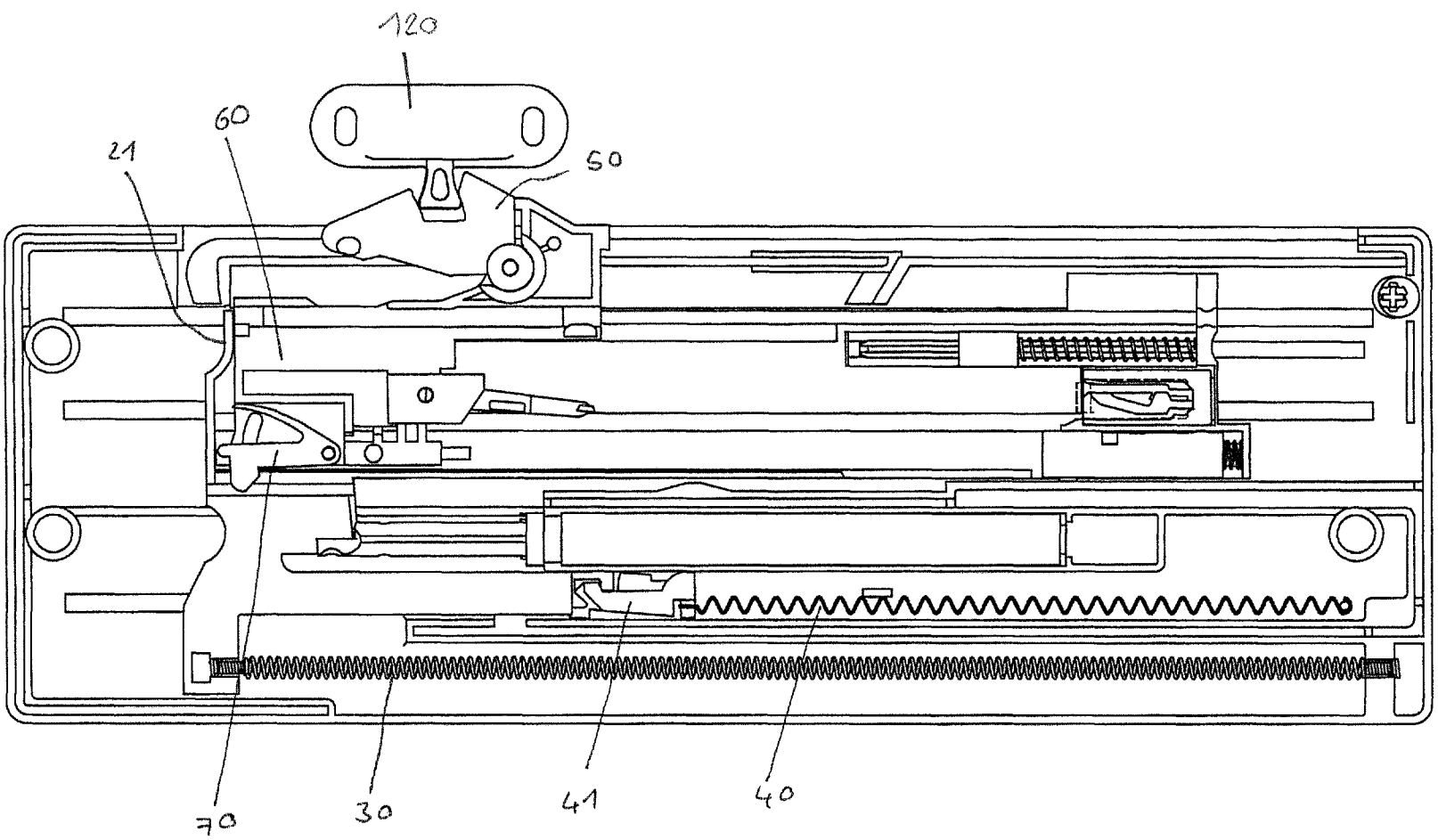
Figure 8:
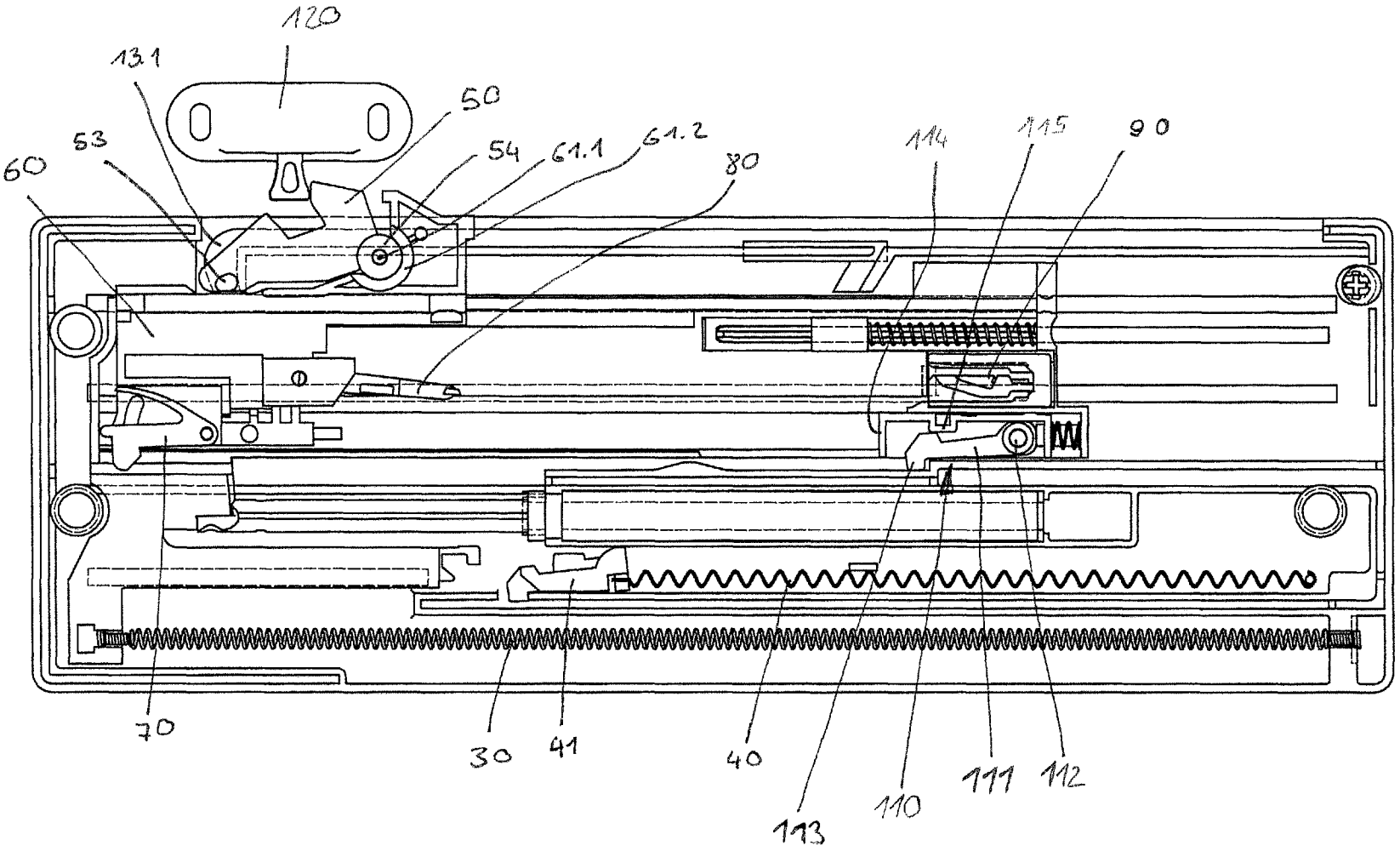
Figure 9:
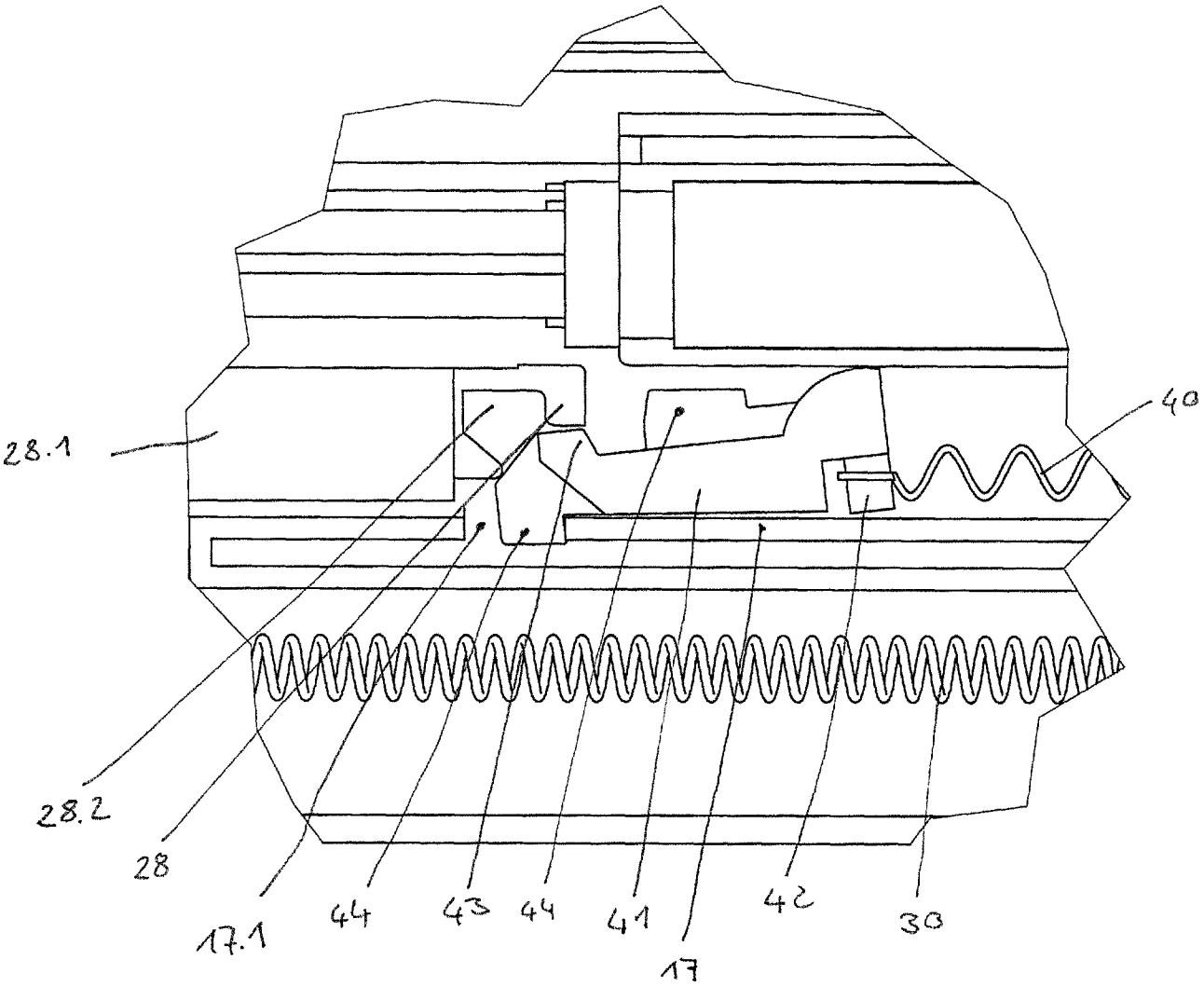
Figure 10:
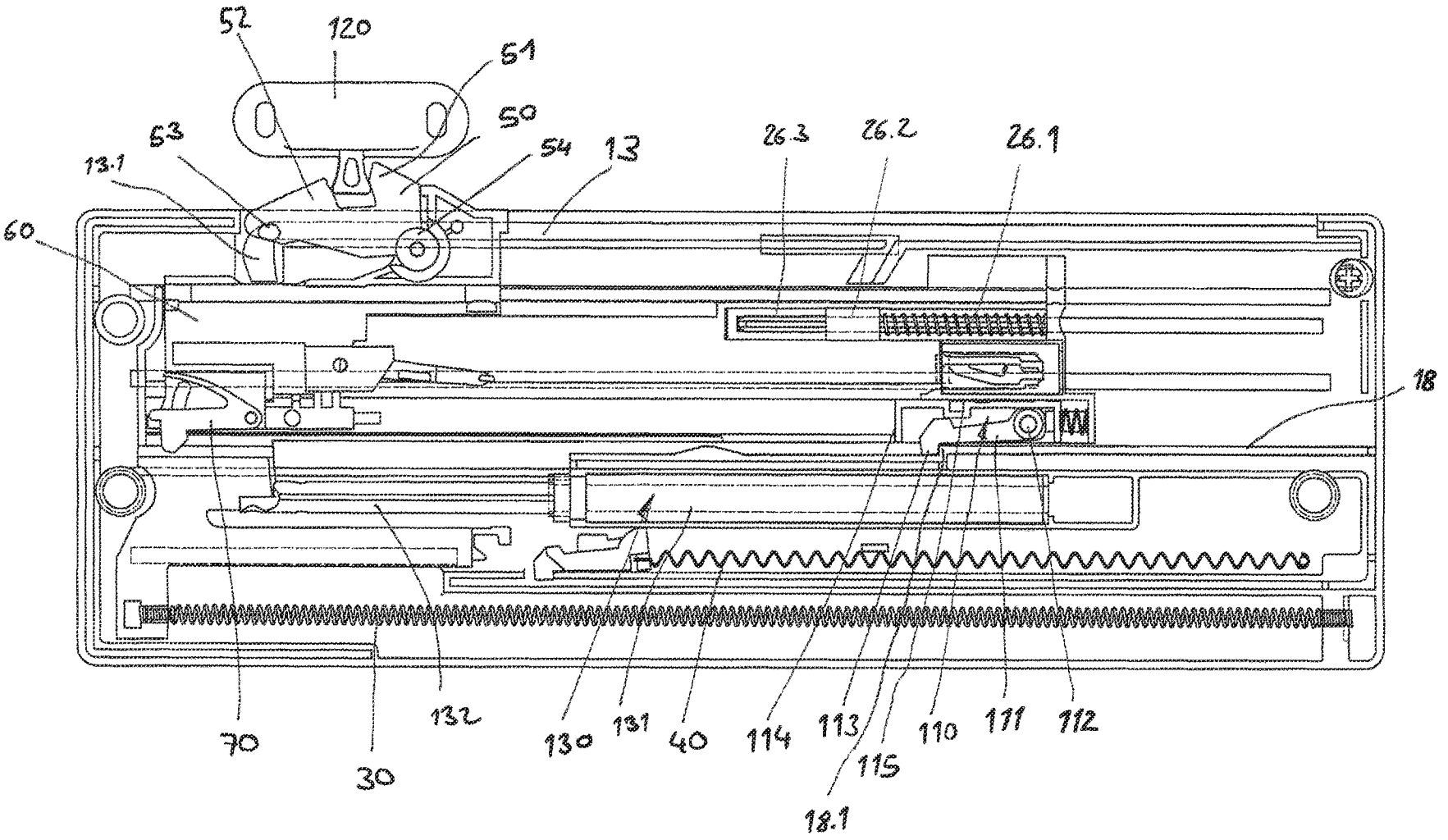
Figure 11:
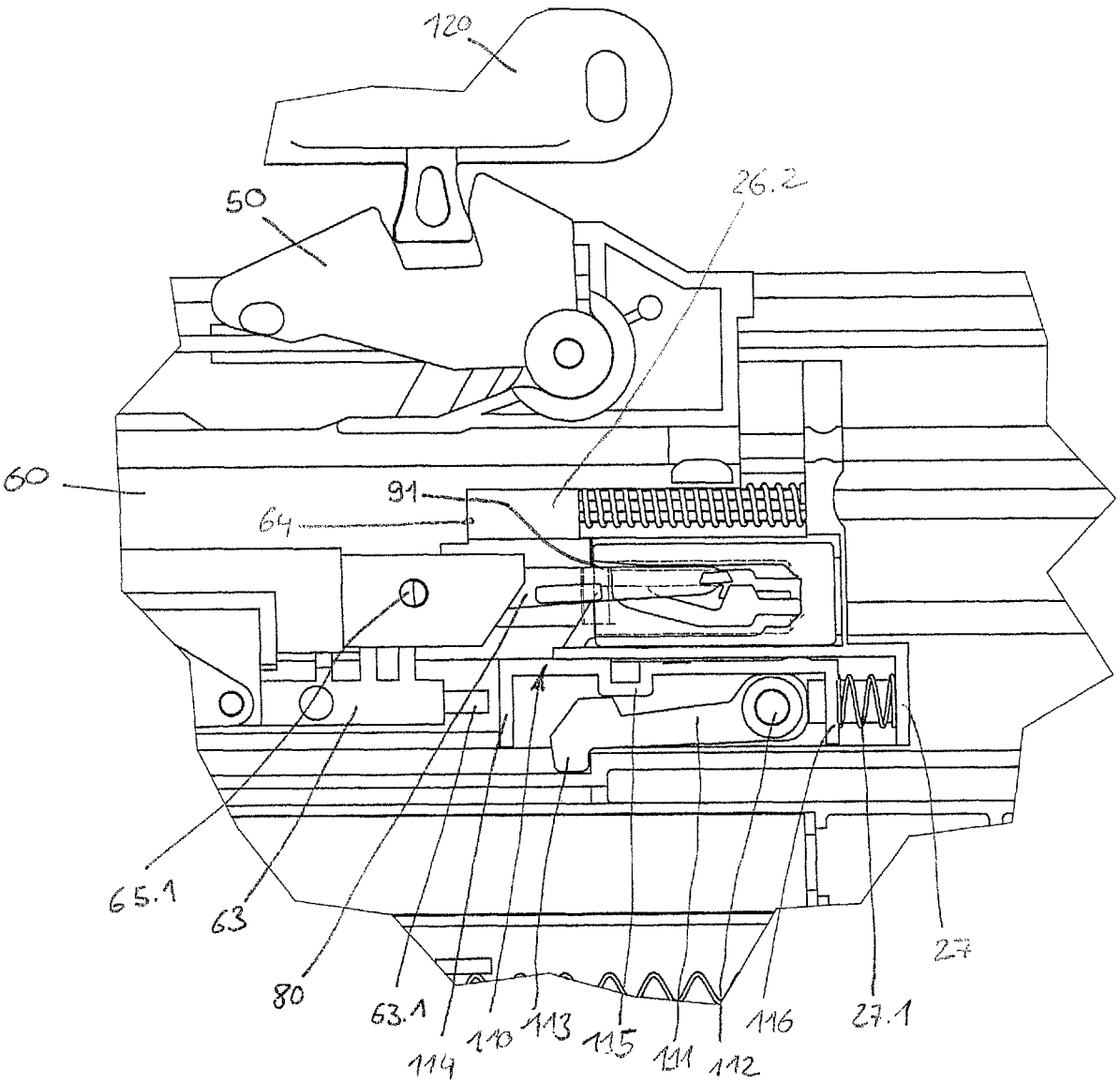
Figure 12:
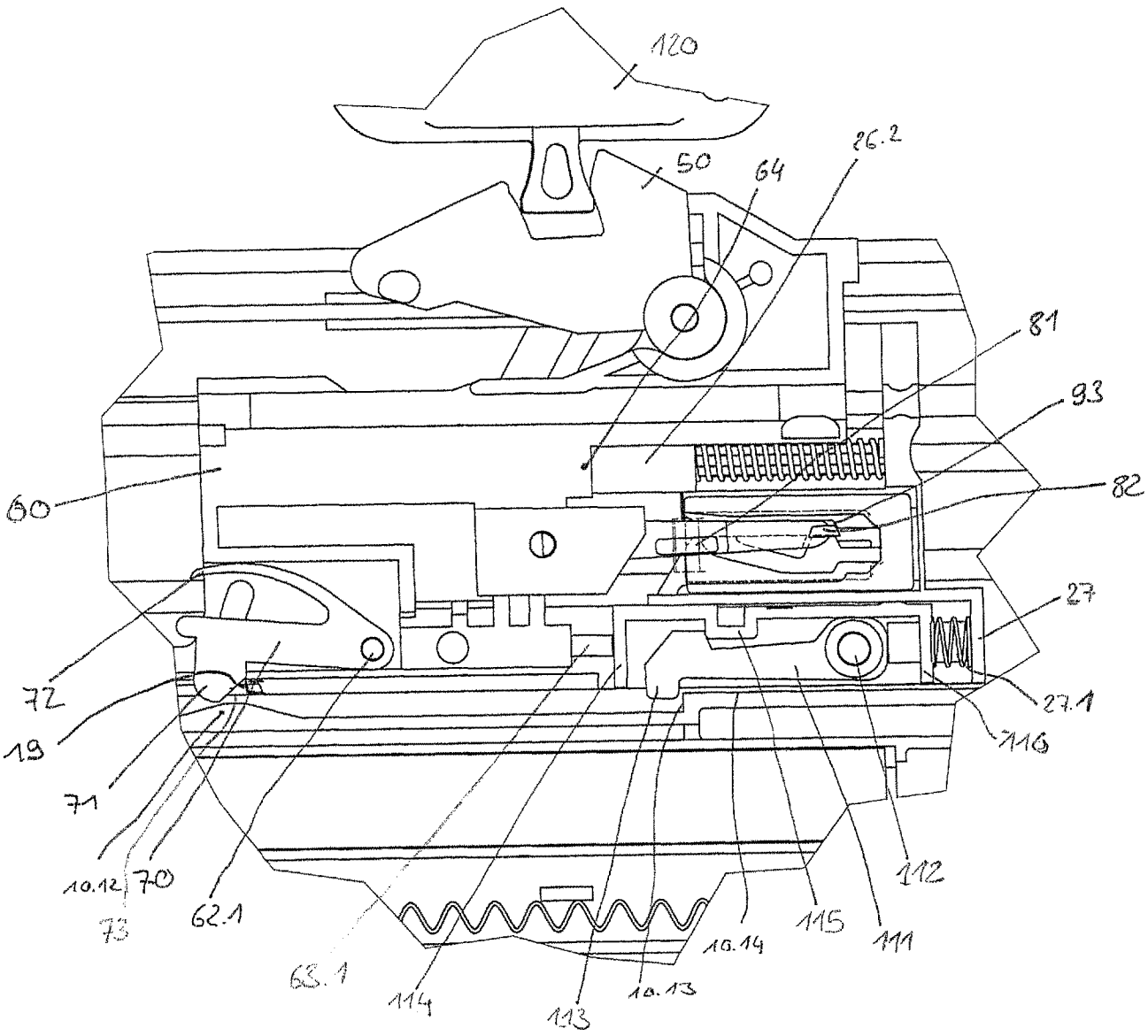
Figure 13:
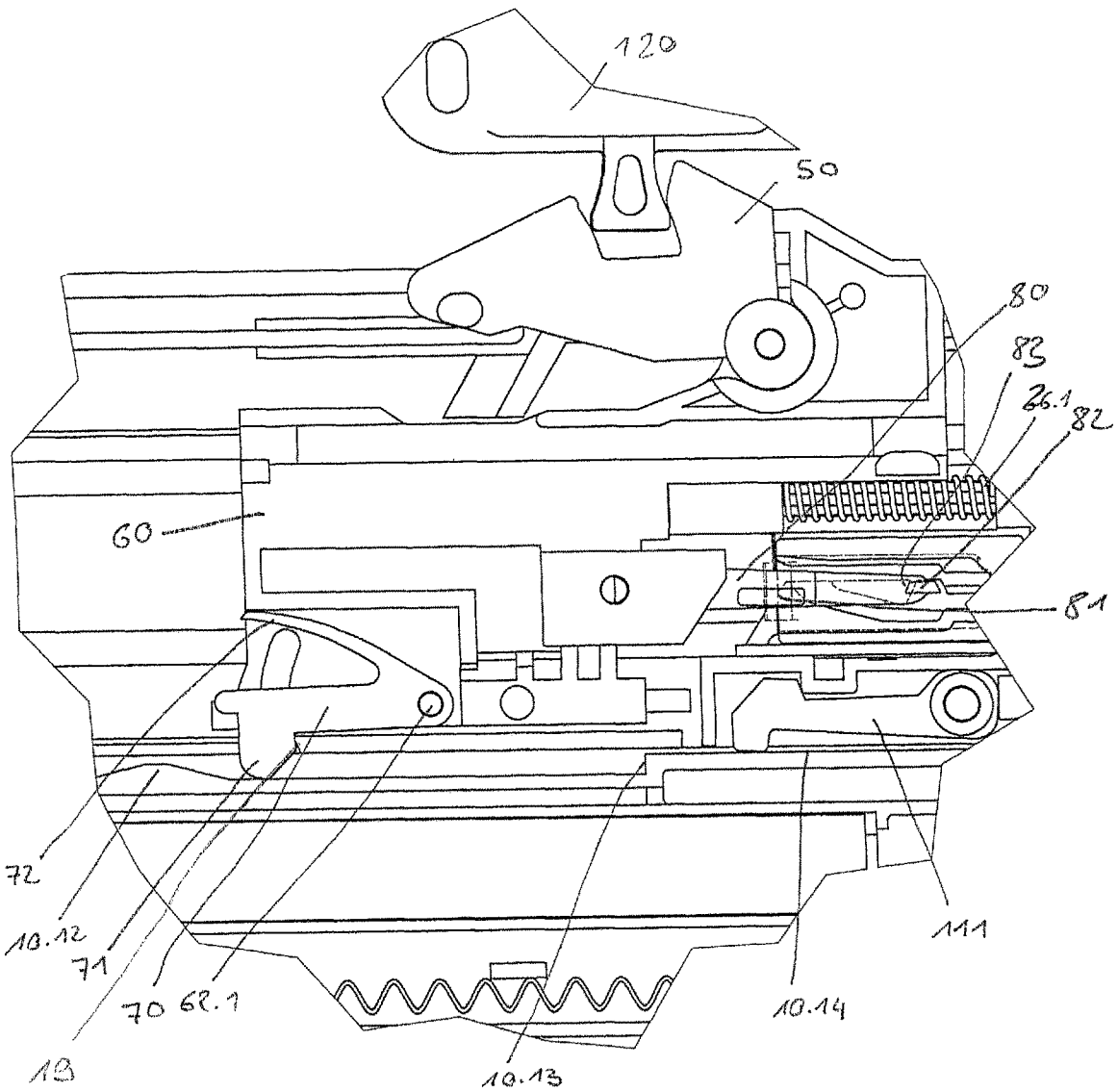
Figure 14:
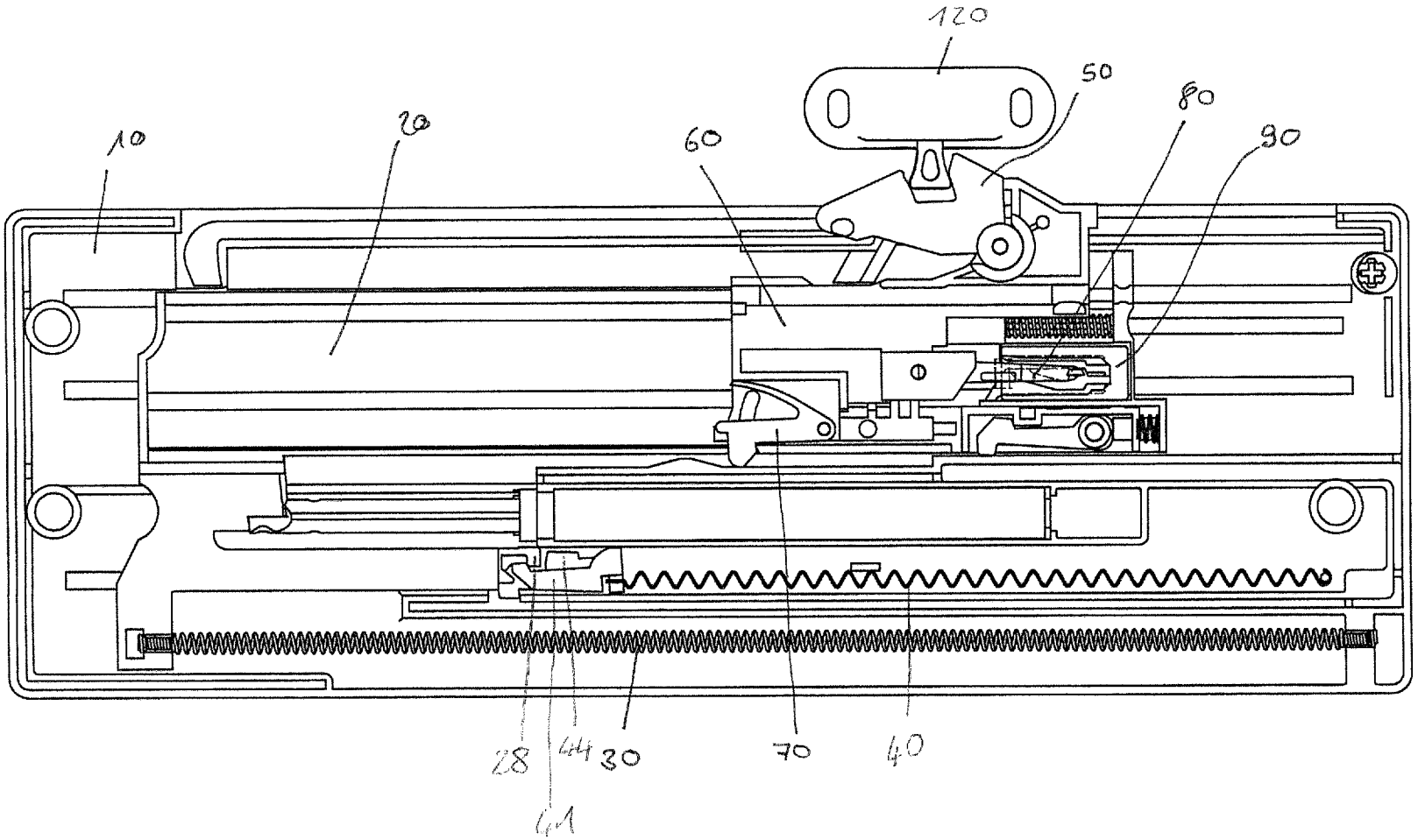
Figure 15:
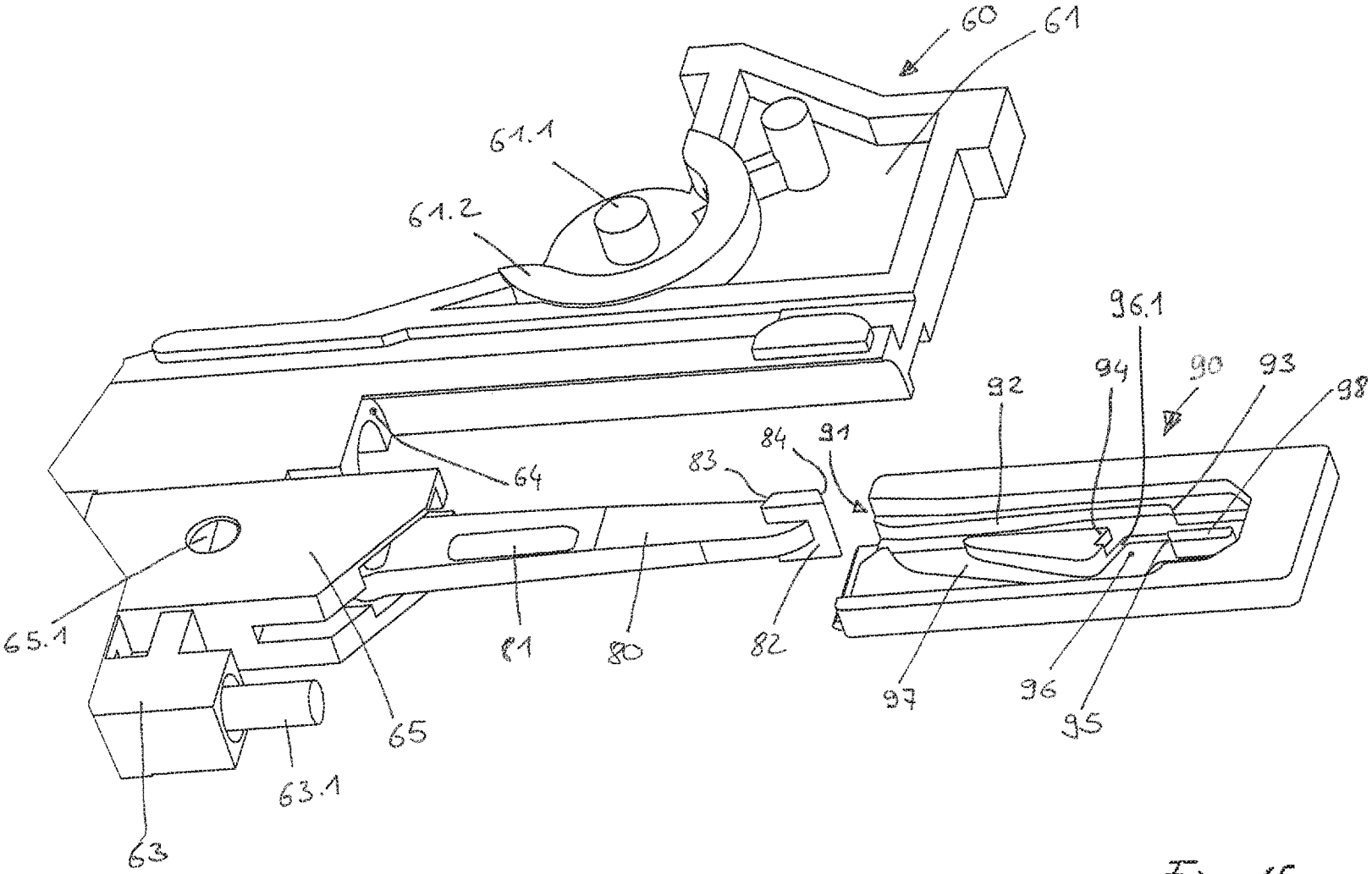
Figure 16:
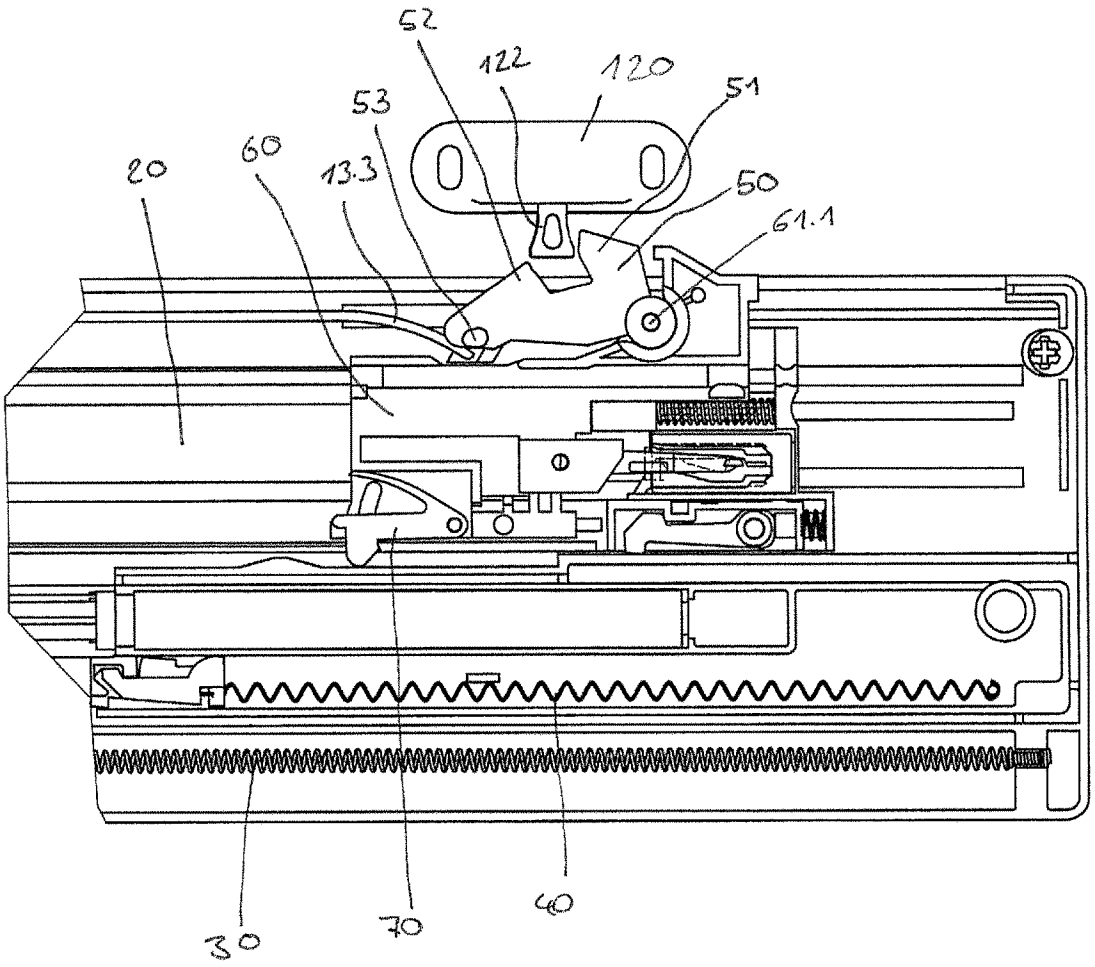
Figure 17:
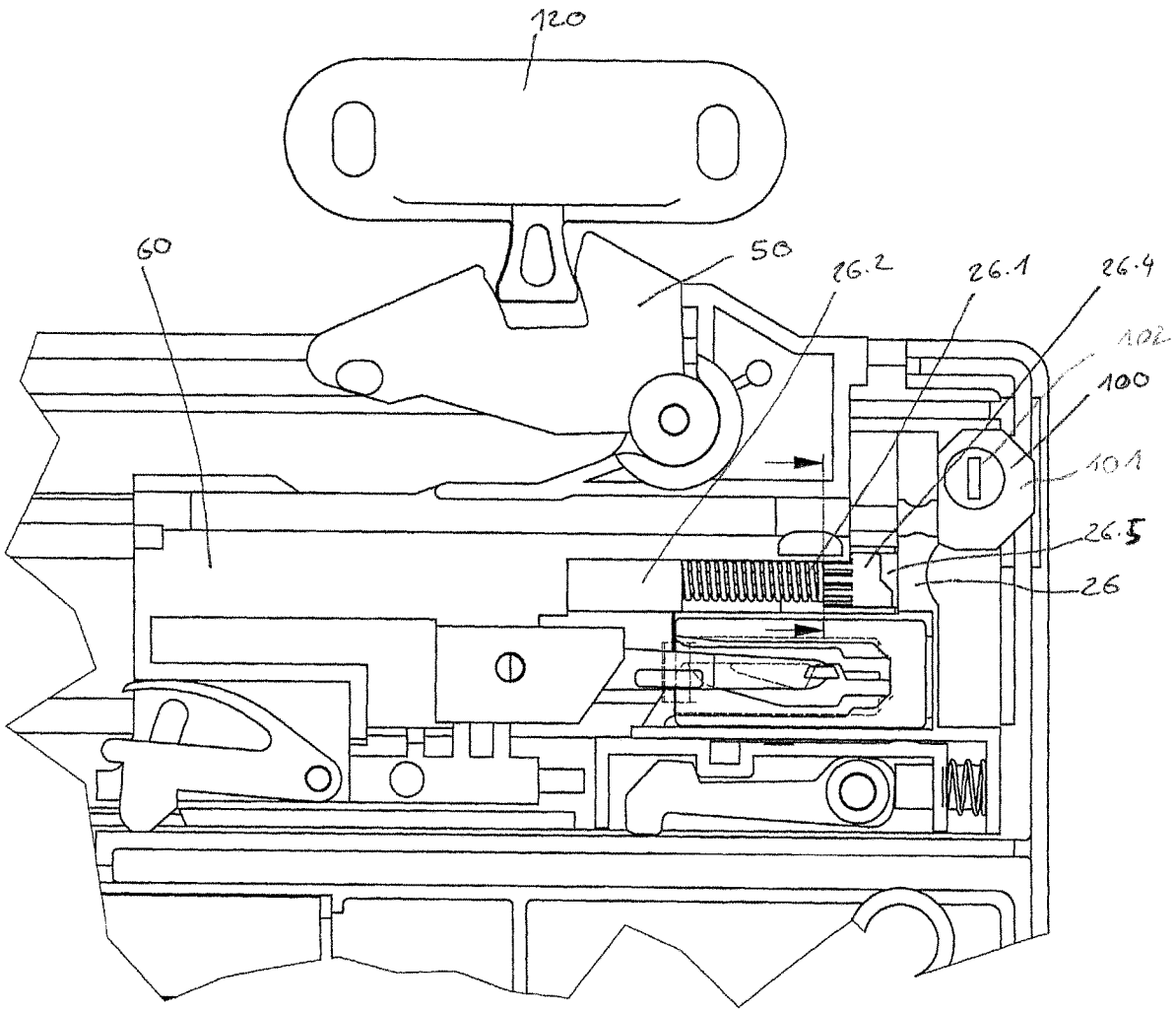
Figure 18:
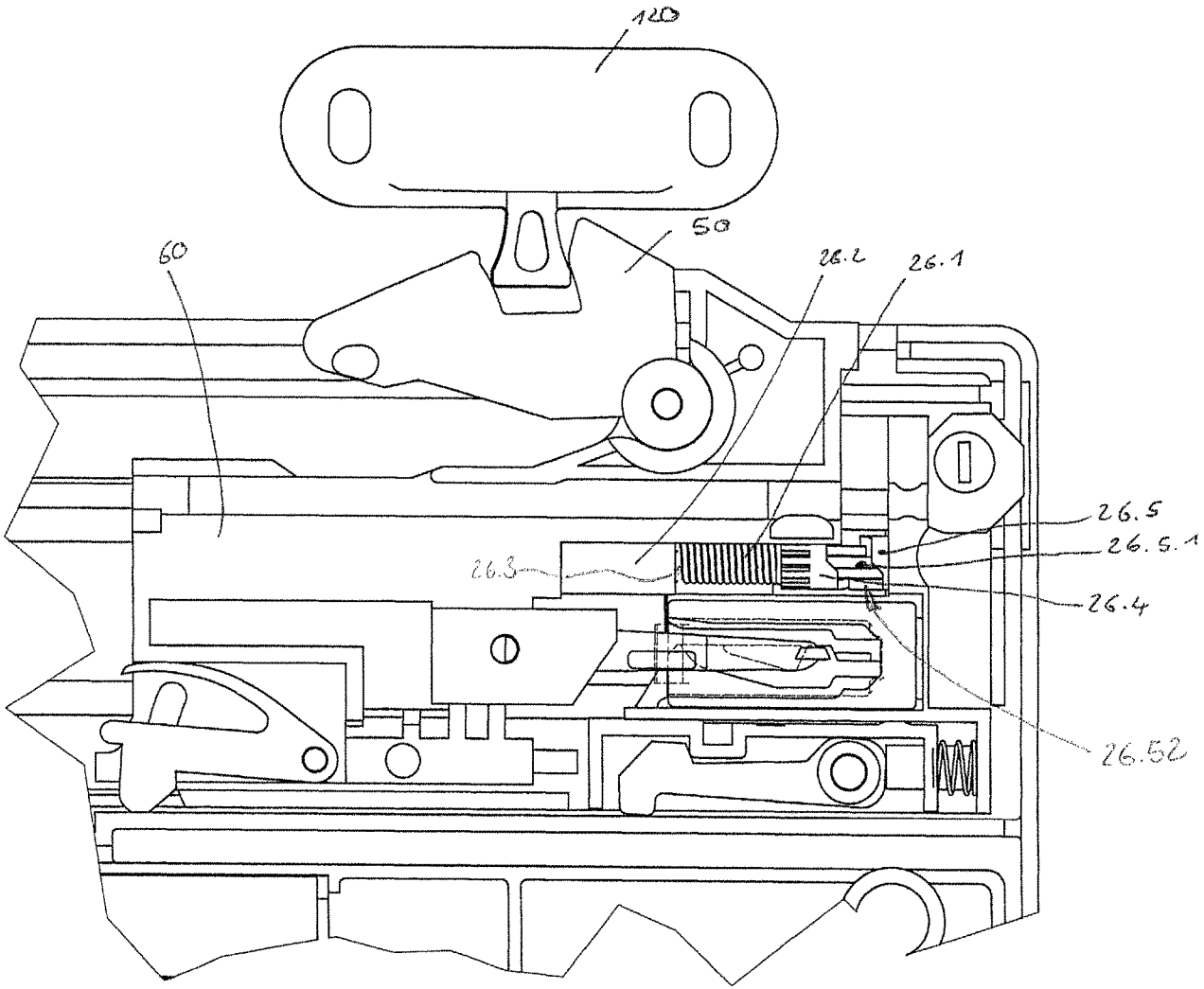
Figure 19:
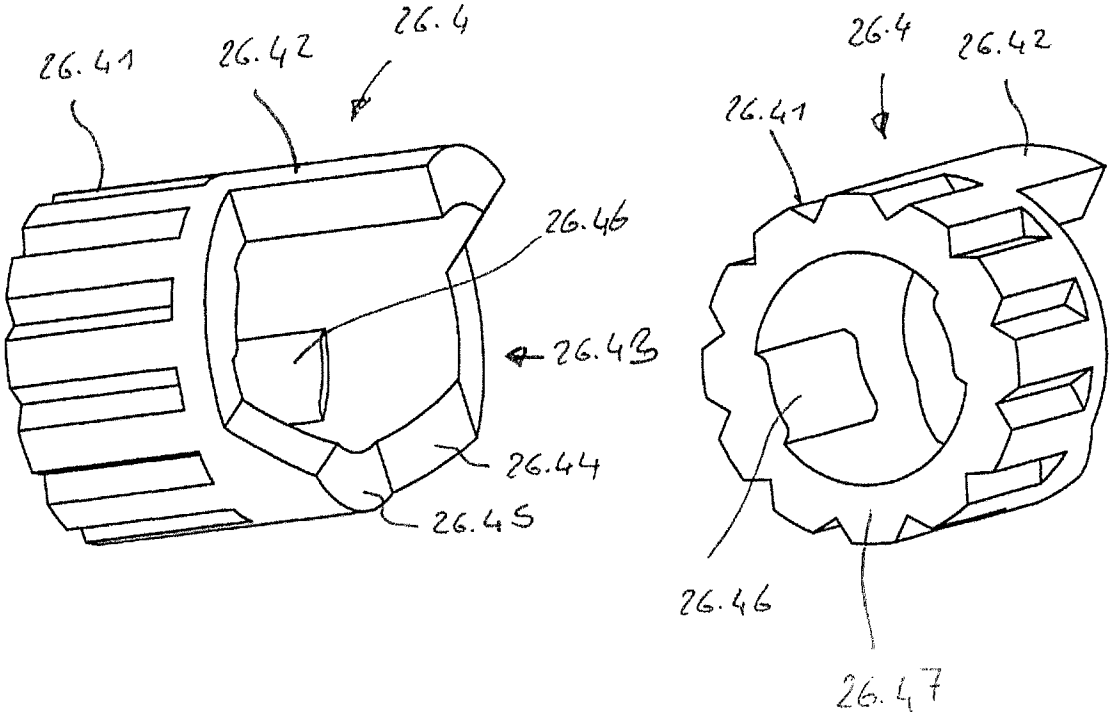
Figure 20:
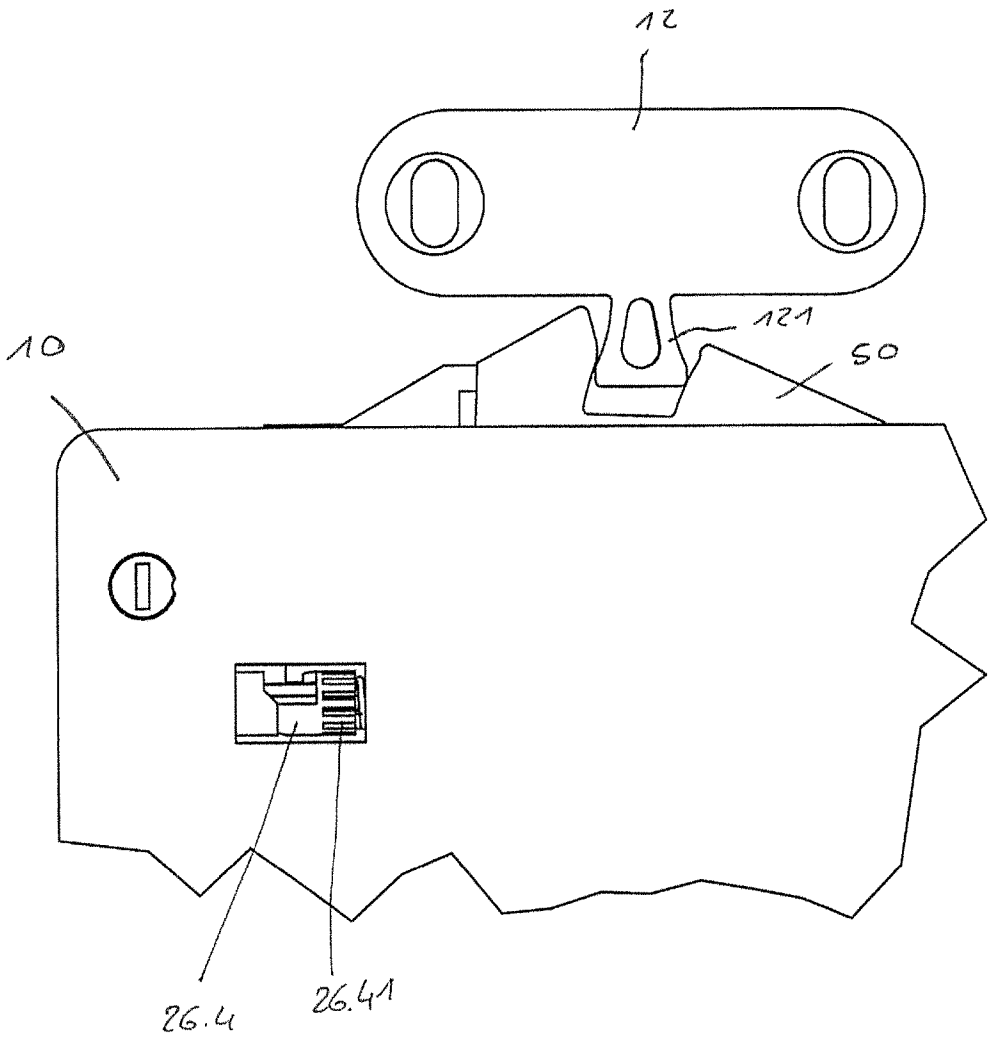

The invention is explained in more detail below by way of exemplary embodiments which are shown in the drawings, in which:

FIG. 1: shows a side view of a movement device for a drawer,

FIG. 2: shows a detail taken from FIG. 1,

FIGS. 3 and 4: show the representation according to FIG. 2 but in an amended switching representation, FIGS. 5-8: show various switching representations of the movement device according to FIG. 1, FIG. 9: shows an enlarged representation of a detail taken from FIG. 8, FIG. 10: shows a further switching position of the movement device, FIG. 11: shows an enlarged representation of the detail taken from FIG. 10, FIGS. 12 and 13: show the representation according to FIG. 11, but in an amended switching position, FIG. 14: shows a further representation of the movement device according to FIG. 1, FIG. 15: shows an enlarged representation in perspective of a part assembly of the movement device according to FIG. 1, FIG. 16: shows the movement devices according to FIG. 1 in a special switching position, FIGS. 17 and 18: show a part representation and side view of a further alternative of a movement device, FIG. 19: shows various perspective views of an adjustment part of the movement device according to FIG. 18, FIG. 20: shows a side view of a detail of the movement device according to FIG. 18.

FIG. 1 shows a movement device with a housing 10, the housing consisting of two housing halves which are connected together. The movement device may also be referred to as a push-to-open slide assembly. To show the mechanism of the movement device, one housing half is not shown in FIG. 1 in order to provide a view into the inner workings of the movement device. As shown in said representation, the housing 10 comprises a wall 11. Fastening receiving means 12 are arranged in the side regions of the wall 11. Fastening screws can be fed through the fastening receiving means 12 and the movement arrangement can be screwed to a furniture part, for example to a drawer to be moved, by way of said fastening screws. The wall 11 is fitted with sliding guides, it being possible for the sliding guides to be realized in the present case as webs. In addition, a guide 13, which can be realized in the form of a groove, is provided on the housing 10. It is also conceivable that in place of the groove, an open guide 13 is introduced into the wall element of the housing 10. The guide 13 has a guide portion 13.4 which runs in the longitudinal direction of the housing 10. On its left-hand side end, the guide portion 13.4 merges into a park portion 13.1. The park portion 13.1 can be formed, as shown in the present case, from angled guide track geometry. It can be realized, in particular, as shown, with an undercut. A further park portion 13.2 is provided in the region between the park portion 13.1 and the oppositely situated end of the guide portion of the 13.4. Said park portion 13.2 is provided as a side widening of the guide portion of the 13.4. The guide portion 13.4 comprises a spring part 13.3 in the region of said park portion 13.2.

As shown in FIG. 1, a slide 20 is arranged in the housing 10. The slide 20 can be displaced in the longitudinal direction of the housing 10 along the sliding guides of the wall elements of the housing 10. The slide 20 comprises a carrier 21 which is fitted with guides 22. The guides 22 interact with the actuating member 60. The slide has a projection 23. Said projection can be integrally molded in one piece in order to reduce the cost of the parts. The projection 23 forms a spring holder 24 and a damper holder 25. The left-hand end of a spring which serves as an energy storing means 30 can be fastened on the damper holder 24. The oppositely situated end of the spring is fastened on a spring holder 14 of the housing 10. A damper 130 is fastened on the damper holder 25. In particular, a piston rod 132 of the damper 130 can be fastened there. The damper 130 can be realized as a linear fluid damper. In particular, it can comprise a damper body 131, for example in the form of a cylinder. In the damper body 131 a piston, which is mounted on the piston rod 132, can be adjusted against the pressure of the fluid held in the damper body 131. In an advantageous manner, the fluid is air such that the damper 130 is maintenance-free and, in particular in the case of a leak, there is no risk of an escape of a harmful fluid, as is the case, for example, with oil dampers.

The end of the damper 130 situated opposite the damper holder 25 is fastened on a housing-side damper holder 16. The slide 20 additionally has a support bearing 26 and a mandrel 26.3, which can be integrally mounted on the slide 20, protrudes from said support bearing 26. An energy storing means, which is realized as a spring, is fitted onto said mandrel and the spring is supported at the end on the support bearing 26. A pressure piece 26.2 is additionally held on the mandrel 26.3 so as to be displaceable in the longitudinal direction of the mandrel 26.3. The pressure piece 26.2 serves for abutment against an actuating member 60, as will be explained subsequently in more detail.

The slide 20 additionally comprises a thrust bearing 27. A spring 27.1 is mounted against said thrust bearing 27. The oppositely situated end of the spring 27.1 is placed against a positioning unit 110. FIG. 11 shows an enlarged representation of the positioning unit 110. As can be seen in said representation, the positioning unit 110 comprises a blocking lever 111 which is mounted so as to be pivotable about a pivot bearing 112. The blocking lever 111 comprises a blocking hook 113 situated opposite the pivot bearing 112. The positioning unit 110 additionally comprises a blocking piece 114 which is part of a slide. In addition, an attachment 115 is provided on the slide and the slide also comprises a support portion 116. The slide is prestressed against the spring 27.1 by means of the support portion 116. The slide of the positioning unit 110 is adjustable from left to right and in reverse horizontally in the image plane in FIG. 11. In this case, it can be pressed against the prestressing of the spring 27.1.

It can also be seen in FIG. 1 that the slide 20 carries a blocking part 28 on an attachment 28.1. Said blocking part 28 interacts with a holder 41 and the holder 41 is guided so as to be linearly adjustable on a guide of the housing 10. In this case, the holder 41 can be displaced from left to right and in reverse in the image plane according to FIG. 1. The holder 41 comprises an attachment 42. An energy storing means 40, in the present case for example a spring, is fastened on said attachment. The oppositely situated end of the energy storing means 40 is fastened on the housing 10 by means of a spring holder 15. The holder 41 additionally comprises a hook 43 which is integrally molded on the holder 41. Finally, the holder 41 also includes a stop 44.

As can also be seen in FIG. 1, an actuating member 60 is held on the slide 20 so as to be linearly displaceable. Guides, which act between the slide 20 and the actuating member 60, are provided for this purpose. The actuating member 60 includes a holder 61 which comprises a bearing bolt 61.1 of a bearing 61.2. A blocking element 50 is pivotably fastened on the bearing 61.2, the pivot plane being perpendicular to the image plane in FIG. 1. The blocking element 50 comprises two stops 51, 52 which are arranged spaced apart from one another. In addition, a guide piece 53 is provided on the blocking element 50. The blocking element 50 is attached by way of a bearing portion 54 on the bearing 61.2. It is conceivable in this case, for example, for the bearing bolt 61.1 to reach through a breakthrough in the bearing portion 54.

The actuating member 60 is fitted with a further bearing 62.1. A lever 70 is pivotably fastened on the bearing 62.1. The pivot direction is once again perpendicular to the image plane. A guide 62.2, which interacts with a guide element of the lever 70, is provided in the actuating member 60. During an offset positioning of the lever 70, the guide element can be moved in a guided manner in the guide 62.2. The lever 70 carries a blocking piece 71 and additionally comprises a spring 72. The spring 72 is supported against a support portion of the actuating member 60 and applies prestressing to the lever 70.

As shown in FIG. 1, the actuating member 60 includes a holder 63. Said holder carries a stop 63.1. The stop 63.1 is realized in order to interact with the positioning unit 110, as will be explained subsequently in more detail.

As has already been mentioned above, the actuating member 60 has a stop 64. Said stop interacts with the pressure piece 26.2. As an alternative to this, it is also possible to dispense with the pressure piece 26.2. The spring 26.1 then interacts directly with the stop 64.

A fastening portion 65 with a pivot bearing 65.1 is arranged on the actuating member 60. A switching element 80 is pivotably fastened on the pivot bearing 65.1. The switching element 80 can be realized, for example, as a lever, as shown in FIG. 1. The design of the switching element 80 can also be seen in more detail in FIG. 2. As shown in said representation, the switching element 80 comprises a projecting region on which a deflection portion 81 is, in particular, integrally molded. The switching element 80 carries a blocking member 82 on its free end. The blocking member 82 can be provided with an undercut 83 and comprises a deflection part 84. The switching element 80 interacts with a switching module 90. The switching module 90 is formed by two housing parts which, in the assembled state, enclose a cavity. The two housing parts can be constructed in a mirror-symmetrical manner in particular at least in the region of the cavity. It is also conceivable for the switching module 90 to be formed only by one housing half. As shown in FIG. 2, the switching module 90 comprises a lead-in region 91. Said lead-in region 91 merges into a guide track 92. The guide track 92 is fitted with a deflection bevel 93. The deflection bevel 93 may also be referred to as a closing deflection bevel. A stop 94 is additionally provided on the switching module 90. According to a preferred design variant of the invention, a blocking edge 94.1 can be provided following the stop 94, as shown in FIG. 2. The blocking edge 94.1 is at an angle to the stop 94. The stop 94 and the blocking edge 94.1 preferably enclose the same or an approximately same angle as the undercut 83. A deflection bevel 95 is provided on a web 98 of the switching module 90. The deflection bevel 95 may also be referred to as an opening deflection bevel. As shown in FIG. 15, the switching module 90 comprises a shoulder 96. The shoulder 96 is provided following the stop 94. Finally, the switching module 90 comprises a return region 97 which once again opens out from the shoulder 96 into the guide track 92.

The function of the movement device is explained in more detail below. The movement device can be fastened to a furniture part, for example a drawer. An entrainment means 120, which interacts with the movement device, is fixed to the corresponding furniture part, for example a furniture carcass. The entrainment means 120 comprises two fastening receiving means 122 for this purpose. The entrainment means 120 can be fixedly screwed to the furniture carcass using fastening screws. It is obviously also possible for the entrainment means 120 to be mounted on the drawer and the movement device on the furniture carcass in a reverse manner. An entrainment means element 121 is integrally molded on the entrainment means 120. The entrainment means element 121 is held between the two stops 51, 52 in FIG. 1.

In the closed state of the drawer, the movement device is situated in the basic position shown in FIG. 1. If an overstroke is then applied onto the front of the drawer, the entrainment means 120 is displaced relative to the blocking element 50. In detail, the blocking element 50 is displaced from left to right in the image plane according to FIG. 1. FIG. 2 shows the assignment of the switching element 80 to the switching module 90. As can be seen in this representation, the switching element 80 is blocked on the switching module 90 in the basic position. In detail, the undercut 83 abuts securely against the stop 94 and the blocking edge 94.1. On account of said blockade, the switching element 80 is prevented from being able to move out of the switching module 90. As the switching element 80 is attached to the actuating member 60, the actuating element 60 is prevented from becoming offset. The actuating member 60 is then prestressed against the energy storing means 26.1. For this purpose, the pressure piece 26.2 abuts against the stop 64. If then, as already indicated above, an overstroke is applied, the blocking element 50 is displaced to the right out of the position shown in FIG. 1. As a result, the gap marked by way of an S in FIG. 3 is reduced. When the gap S is fully closed, the actuating element 60 abuts by way of its holder 61 against a wall of the housing 10, as a result of which further offset of the actuating member 60 is prevented.

Figure 5:
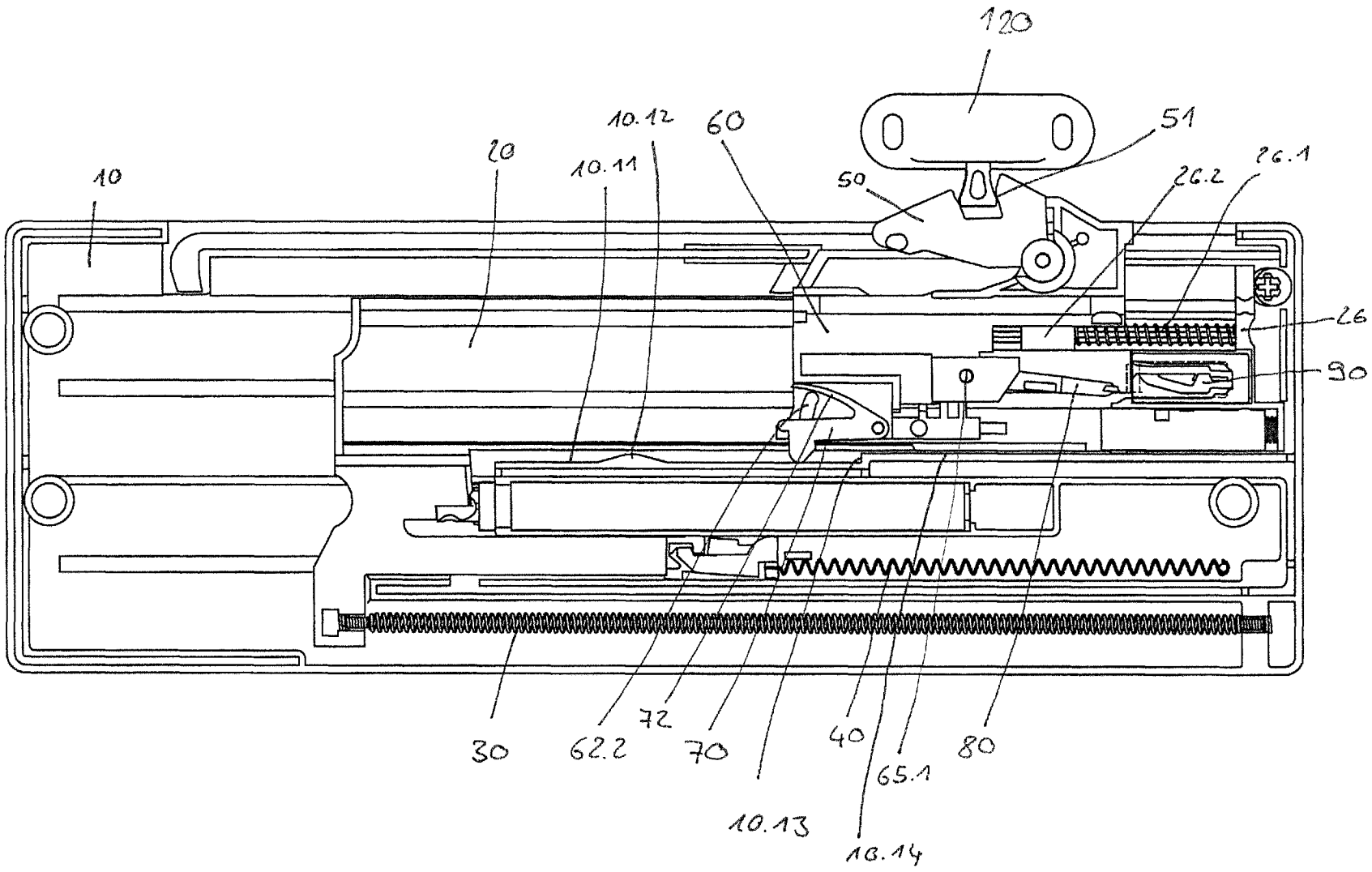
Figure 6:
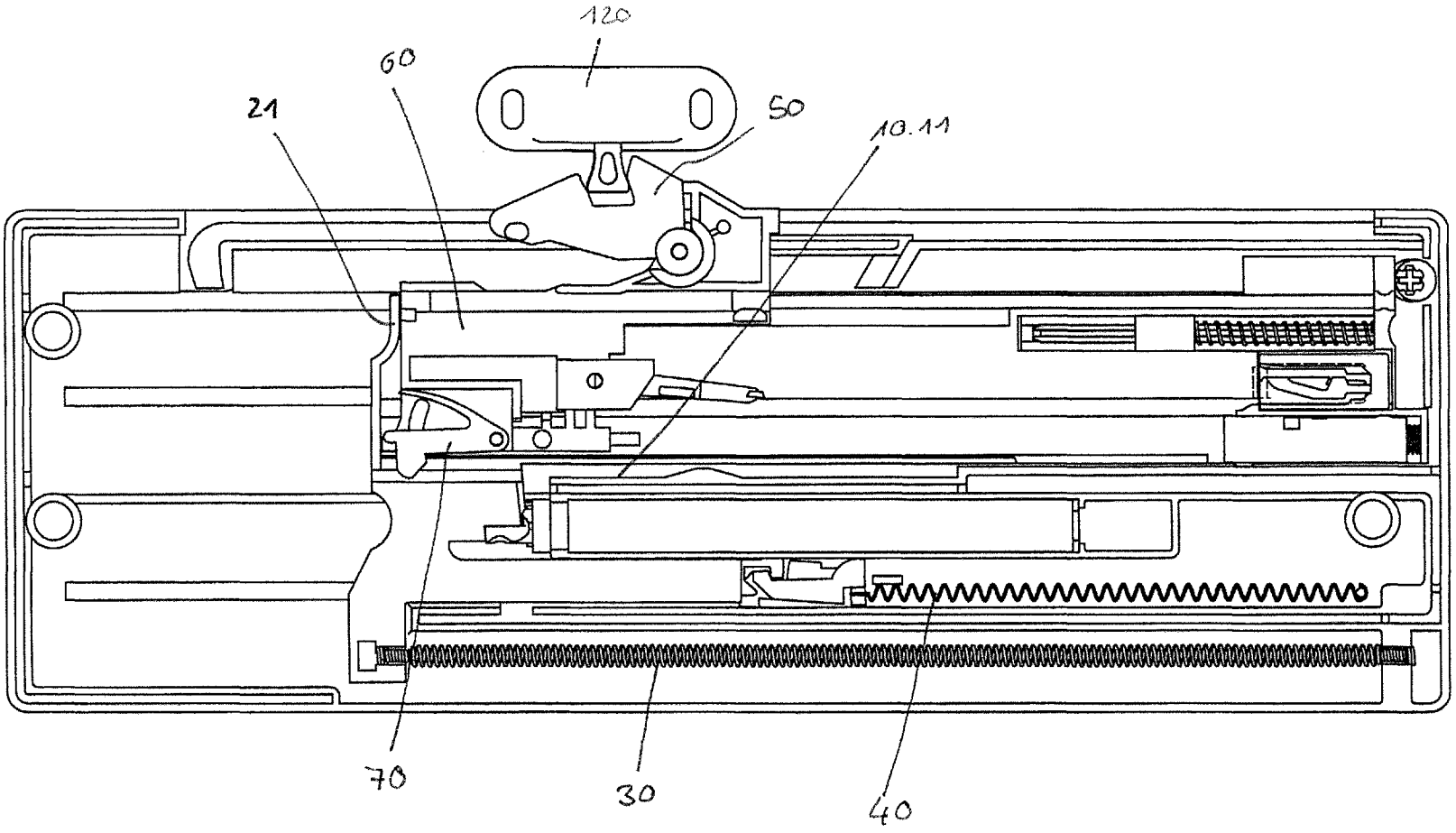

As the sequence of figures from FIG. 2 to FIG. 3 shows, when the overstroke is applied, the blocking element 82 of the switching element 80 is lifted from the stop 94 in a first adjusting movement. After a short travel in the direction of the overstroke, the blocking member 82 is deflected sideways into the shoulder 96 transversely to the overstroke direction, perpendicularly to the image plane and into the plane in FIG. 3. The image plane of FIG. 3 may also be described as a vertical plane parallel to the overstroke direction. As a result of said combined movement of the blocking member 82, on the one hand along the first adjustment movement and transversely thereto into the shoulder 96, the switching path of the overstroke mechanism is significantly reduced and the blocking member 82 is moved past the blocking edge 94.1. In an advantageous manner, the first switching movement extends for less than or equal to 1 mm up to the point at which the blocking member 82 is deflected sideways. The lateral offset of the blocking member 82, according to the present exemplary embodiment, is made possible as follows. The switching element 80 is supported by way of its deflection portion 81 against an assigned housing contour of the switching module 90. In this case, the switching element 80 is deflected in a resilient manner. In this respect, prestressing is applied to the switching element 80. On account of said prestressing, the blocking member 82 snaps into the shoulder 96 when the step 96.1 of the shoulder 96 is run over by the blocking member 82. Said position is shown in FIG. 3. As noted above this movement of the blocking member 82 into the shoulder 96 when the blocking member 82 runs over the step 96.1 is a motion in a sideways direction transversely to the overstroke direction and transversely to the vertical plane of the image of FIG. 3. The blocking member 82 is consequently released and it can pass into the return region 97. If, then, however, the overstroke is continued further, for example when a user continues to press on the panel of the drawer, the blocking member 82 thus moves into contact with the deflection bevel 95. Since the blocking member 82 has been released, it can be deflected further downward at the deflection bevel 84 until it passes into the return region. This further movement of the blocking member 82 in a downward direction can also be referred to as a movement vertically transversely to the overstroke direction. When then the pressure is taken off the panel of the drawer, the energy storing means 26.1 can thus relax. In this case, the pressure piece 26.2 pushes the actuating member 60 out. FIG. 5 shows an actuating position of the actuating member 60 where it is already no longer in contact with the pressure piece 26.2. In a corresponding manner, the energy storing means 26.1 has transferred its energy into the actuating member 60 and it is able to freewheel. In dependence on the energy introduced, the actuating member 60 can freewheel until it comes to rest against a stop of the carrier 21. The drawer is then situated in a part-open position. It can then be gripped, for example, by the panel and pulled out. In this case, the actuating member 60 is displaced together with the slide 20 via the blocking element 50. The actuating member 60, which strikes against the carrier 21, pulls the slide 20 from right to left in the image plane according to FIG. 7. In this case, both energy storage means 40 and 30 are loaded, for example two springs are tensioned. FIG. 7 shows a part-expansion coupling of the two springs. The blocking element 50 can be adjusted via the entrainment means 120 until it passes into the region of the park portion 13.1 of the guide 13. Where there is offset from the position according to FIG. 1 up to the representation according to FIG. 8, the blocking element 50 is guided on the in particular, linear guide portion 13.4 of the guide 13 by means of the guide piece 53. As soon as the guide piece 53 reaches the transition region between the guide portion 13.4 and the park portion 13.1, it forces the blocking element 50 into its tilted position, as shown in FIG. 8. A curved contour is provided on the guide 13 for this purpose, in particular, at which the guide piece 53 is deflected and moved into the park position of the park portion 13.1. As shown in FIG. 8, with the blocking element 50 in the tilted position, the entrainment means 120 is released. The drawer can then be pulled out freely. In the tilted position, the blocking element 50 blocks the movement device. In particular, the guide piece 53 blocks the actuating member 60 and consequently also the slide 20.

As shown in FIG. 8, with the adjustment of the slide 20, both energy storing means 30 and 40 are initially tensioned simultaneously. A special feature, however, here is that the energy storing means 40 is initially discarded during the movement. This is explained in more detail by way of FIG. 9. As shown in said representation, the holder 41 is adjusted together with the slide 20 during the movement. Via the attachment 42, the energy storing means 40 introduces a torque, which acts in a counter-clockwise manner, into the holder 41. The holder 41 slides along a guide track 17 of the housing 10 until the stop 44 passes into the region of a recess 17.1 of the guide track 17. On account of the acting torque, the stop 44 is deflected into the recess 17.1. As a result, the holder 41 tilts. Consequently, however, the holder 41 also moves out of engagement with the shoulder 28.1. In detail, in this case, the holder 43 moves out of a holder receiving means 28.1 such that the blocking part 28 is released. The holder 41 is pulled against the rear delimiting edge of the recess 17.1 and is held there in a tensioned manner on account of the acting torque and with the energy storing means 14. The energy storing means 40 is consequently discarded. The slide 20 can be displaced further to the left. FIG. 10 shows the movement device in an intermediate position between discarding the energy storing means 40 and transferring the blocking element of the 50 into its tilted position. As can be seen from said representation, the positioning unit 110 mounted on the slide 20 is also entrained when the slide 20 is offset as far as into said position. In this case, the blocking lever 111 of the positioning unit 110 is guided along a guide track 18 of the housing 10. The guide track 18 comprises a blocking edge 18.1. The blocking lever 111 with its blocking hook locks on said blocking edge as soon as it has reached the position shown in FIG. 10. The blocking hook 113 is secured in said position with the attachment 115 of the blocking piece 114. The blocking lever 111 is accordingly no longer able to move in a clockwise manner and consequently is no longer able to move out of engagement with the blocking edge 18.1.

When the movement device is situated in the open position shown in FIG. 8, both energy storing means 30 and 40 are therefore prestressed, the energy storing means 26.1 is relaxed, the switching element 80 is moved out of the switching module 90 and the blocking lever 111 is locked. The damper 130 is situated in its open position.

If then the drawer is moved back again out of its open position in opposite directions, the entrainment means 120 contacts the blocking element 50. As the contact point of the entrainment means 120 is arranged at a spacing from the pivot axis of the bearing 61.2, a torque is introduced into the blocking element 50. Said torque, acting in a clockwise manner, rotates the blocking element 50 out of the park position shown in FIG. 8 until the guide piece 53 passes into the region of the guide portion 13.4 of the guide 13. The entrainment means 120 is then caught between the two stops 51 and 52, as shown in FIG. 10. Since the guide piece 53 is now no longer blocked, the blocking element 50 can be adjusted freewheeling from left to right. The actuating member 60 is then also displaced along the slide 20 from left to right with the blocking element 50. During said adjustment movement, the actuating member 60 contacts the pressure piece 26.2 by way of its stop 64, as is shown in FIG. 11. As is further shown in said representation, the switching element 80 moves into the switching module 90. As the drawer continues to be pushed closed, the stop 63.1 contacts the blocking piece 114, as shown in FIG. 12. In this case, the switching element 80 with its blocking member 82 also moves against the deflection bevel 93. As the drawer continues to be moved further, the blocking member 82 is run past the deflection bevel 93 and moved into the locking position such that it abuts against the stop 94. At the same time, the stop 63.1 also pushes the blocking piece 114 in opposition to the prestressing of the spring 27.1. As a result, the attachment 115 of the blocking piece 114 passes into a position which is offset to the right so that the blocking lever 111 is released, as shown in FIG. 12. As a result, the blocking lever 111 can be released from the step 10.13. If, however, the blocking lever 111 is released from the step 10.13, the slide 20 is also released. As a result, both energy storage means can then be triggered one after the other in a cascade-colored manner. With the release of the blocking lever 111, the energy storing means 30 is initially triggered and it can pull the slide 20 from left to right. This occurs against the force of the pulled-out damper 130. So that the actuating member 60 in the locking position shown in FIG. 13, in which the switching element 80 is held against the stop 94, is prevented from being able to be displaced in relation to the slide 20, a locking edge 19 is provided on the housing 10. Said locking edge 19 interacts with the lever 70. As shown in FIG. 13, the lever 70 is held in a prestressed manner in the position shown by means of the spring 72. The blocking piece 71 of the lever 70 is hooked on the locking edge 19. Consequently, an offset of the actuating member 60 in relation to the slide 20 is prevented in the closing direction. This results in the overstroke mechanism not being able to be moved in overstroke and consequently ensures that the blockade in the switching module 90 cannot be released. Said risk exists, in particular, when vibrations occur or when a user might press on the drawer again during the automatic closing movement. The locking of the actuating member 60 in relation to the slide 20 with a switchable lever 70 to block the locking of the switching element 80 during the closing movement provides an independent inventive concept.

FIG. 14 shows that the energy storing means 40 can also be triggered as the drawer is closed further by means of the energy storing device 30. In detail, to this end, the blocking part 28 of the slide 20 contacts the stop 44 of the holder 41 and deflects it in a clockwise manner in opposition to the torque induced by the energy storing means 40. As a result, the stop 44 of the holder 41 is lifted out of the recess 17.1 and the $2^{nd}$ energy storing means 40 is released, as a result of which it can be relieved of tension. In this way, a cascade connection between the two energy storing means 30, 40 is brought about. The maximum force to open the drawer is reduced by means of the cascade connection. In particular, the necessary force for opening can be reduced with the discarding of the energy storing means 40, which enables the drawer to be opened in a more pleasant manner. On the other hand, the energy storing means 40 is supported during the closing operation such that certain pulling-closed is ensured. During part of the closing movement, both energy storing means 30 and 40 pull the slide 20 in the direction of the closed position. The closed position is shown again in FIG. 1. As can be seen in said representation, the blocking piece 71 of the lever 70 is moved above the step 10.13 and is deflected there by means of a deflection bevel 73 (see FIG. 12). The actuating member 60 is consequently no longer blocked in relation to the slide 20. The movement device is consequently released such that a renewed overstroke to open the drawer is able to be applied.

During the transfer of energy between the two energy storing means 30 and 40 when the drawer is being closed, it is not simply just the slide 20 with the actuating member 60 that is pulled by the two energy storing means 30 and 40. Rather, said two energy storing means 30 and 40 also pull the actuating member 60 against the pressure piece 26. The basic position shown in FIG. 1 can be achieved again in this way.

A user can then want to open a drawer without applying an overstroke onto the panel of the drawer. In other words, he tries to open the drawer without overstroke. In order to prevent damage to the movement device in this case and to make it possible to open the drawer, the movement device provides the second park portion 13.2 in the region of the guide. If, therefore, the drawer is pulled, the blocking element 50 is pulled from the entrainment means 120. This is shown in FIG. 16. As can be seen from said representation, the actuating element 60, which is coupled with the blocking element 50, is also pulled with the blocking element. As then the slide 20 is coupled with the actuating member 60 via the switching element 80 and the switching module 90, the slide 20 is also pulled. The two energy storing means 30, 40 are also tensioned with the adjustment of the slide 20. On account of the prestressing of the energy storing means 30 and 40, a closing force, which acts in opposition to the opening direction of the drawer, is introduced into the blocking element 50. At the same time, in the contact region between the entrainment means 122 and the stop 52 of the blocking element 50, the entrainment means 120 introduces a force into the blocking element 50 which acts in opposition to the opening direction. Said force induces a torque which rotates about the bearing 61.2 in an anticlockwise manner. As soon as the blocking element 50 is then pulled into the region of the spring part 13.3 of the guide 13, said torque causes the spring element 13.3 to deflect and the blocking element 50 is consequently deflected into the $2^{nd}$ park position 13.2. As can be seen in FIG. 16, the entrainment means 120 is then released and the drawer is able to be pulled out. If then the drawer is closed again, the entrainment means element 122 moves against the stop 51 of the blocking element 50. As a result, a torque acting in a clockwise manner is introduced into the blocking element 50. Said rotating element lifts the blocking element 50 out of its tilted position so that the guide piece 53 is able to pass into the region of the guide portion 13.4 again. The two energy storing means 30 and 40 pull the blocking member 50 back again into the initial position shown in FIG. 1.

FIGS. 17 and 20 show a movement device which has been modified in relation to FIGS. 1-16. Said movement device shown in FIGS. 17-20 matches the movement device described above totally apart from the differences described below.

As shown in FIG. 17, an adjustment device 26.5 is arranged in the region of the energy storing means 26.1. In particular, said adjustment device 26.5 can be arranged in the region between the support bearing 26 and the energy storing means 26.1. The adjustment device 26.5 consists substantially of two components, namely an adjustment part 26.4 and a counter bearing 26.51.

The design of the adjustment part 26.4 is explained in more detail with reference to FIG. 19. As is shown in said representation, the adjustment part 26.4 comprises a handle 26.41. The handle 26.41 comprises a surface structure which facilitates the operating of the adjustment part 26.4. An attachment 26.42 is integrally molded on the handle 26.41. The attachment 26.42 forms an adjustment curve 26.43. Said adjustment curve 26.43 comprises support portions 26.45 which are merged into one another by means of transfer portions 26.44. The adjustment part 26.41 can be realized, in particular, in a sleeve-shaped manner, as shown in FIG. 19. As is illustrated in FIG. 18, the counter bearing 26.51 is attached to the slide 20. In particular, it can be connected in one piece to the slide 20 in order to reduce expenditure on parts. The counter bearing 26.51 comprises, corresponding to the adjustment curve 26.43 of the adjustment part 26.4, an adjustment contour 26.52. As can be seen in FIG. 18, the adjustment part 26.4 is threaded onto the mandrel 26.3. The mandrel 26.3 comprises latching grooves which are arranged distributed over the periphery of the mandrel 26.3 corresponding to the number of support portions 26.45. As an alternative to this, latching grooves which are distributed uniformly circumferentially can also be provided on the mandrel 26.3, the circumferential distance between the individual latching grooves corresponding to the circumferential distance between two support portions 26.45. The latching grooves extend in the longitudinal direction of the mandrel 26.3. As shown in FIG. 19, the adjustment part 26.4 has latching elements 26.46. When the adjustment part 26.4 is threaded onto the mandrel 26.3, the latching elements 26.46 engage in the assigned latching grooves. The adjustment part 26.4 is supported with its adjustment curve 26.43 on the adjustment contour 26.52. Oppositely situated to the adjustment curve 26.43, the adjustment part 26.4 comprises a support surface 26.47. When then the adjustment part 26.4 is rotated, the adjustment curve 26.43 thus slides along the adjustment contour 26.52. As a result, the adjustment part 26.4 is adjusted axially in the direction of the longitudinal extension of the mandrel 26.3. As the energy storing means 26.3 is supported on the support surface 26.47 at its end facing the adjustment part 26.4, the energy storing means 26.3 can be compressed more or less in the position shown in FIG. 1 as a result of rotating the adjustment part 26.4. As a result, the prestressing of the energy storing means 26.1 is able to be varied. Due to the amendment of the prestressing, the available opening force for moving the drawer can consequently also be amended. Consequently, therefore, the movement device is able to be adapted, for example, to the weight of a drawer. In the case of a lighter drawer, the prestressing is reduced and in the case of a heavier one it is increased. When the adjustment part 26.4 is rotated, it is always held securely in the individual adjustment positions as the latching elements 26.46 latch into the latching grooves of the mandrel 26.3. As can be seen in FIG. 20, the adjustment part 26.4 is accessible from the outside such that it is able to be operated in a comfortable manner. For this purpose, a recess, which provides access to the handle 26.41 of the adjustment part 26.4, is provided in a housing part of the housing 10.

In the case of the movement devices according to FIGS. 1-20, the position of the blocking element 50 is able to be varied. In this way, it is consequently also possible to vary the position of the panel with reference to the furniture carcass. This is significant, in particular when, for example, in a kitchen several drawers are mounted side by side. All the panels are then to be aligned with one another. An adjustment element 100 is consequently used according to the invention. As shown in FIG. 1, the adjustment element 100 has an eccentric 101. The adjustment element 100 is rotatably mounted in the housing 10, the rotational axis being perpendicular to the image plane according to FIG. 1. The adjustment element 100 additionally has a tool receiving means 102. Said tool receiving means 102 is accessible through a breakthrough in the housing 10. As can also be seen in FIG. 1, the actuating element 60 abuts against the eccentric 101 with a support surface. In the present case, the eccentric 101 is supported against the support surface in the region of the support bearing 26. If the adjustment element 100 is then rotated by means of a tool on its tool receiving means 102, the eccentric 101 thus adjusts the actuating member 60 to the left or to the right horizontally depending on the direction of rotation in the image plane according to FIG. 1. The position of the panel of the drawer can be varied in this way. Whereas the invention variant according to FIGS. 1-16 shows a stepless eccentric 101, in the case of the invention variant according to FIGS. 17-20 a stepped eccentric 101 is used. The individual steps of said eccentric 101 abut against the support surface in a flat manner in the corresponding adjustment position.

The invention claimed is:

1. A movement device for a drawer, comprising:

a push-to-open slide assembly configured to move from a closed position to a part-open position corresponding to a closed drawer position and a part-open drawer position, respectively, the push-to-open slide assembly including an overstroke mechanism including:

a switching element including a blocking member; wherein the blocking member includes a beveled deflection part;

a switching module including a stop configured to be engaged by the blocking member in the closed position to hold the switching element against an opening movement of the drawer;

wherein the switching element and the switching module are configured such that when an overstroke inward motion in an overstroke direction is applied to the drawer the blocking member is disengaged from the stop in a first switching movement and during the overstroke inward motion the blocking member is offset in a sideways direction transversely to the overstroke direction and transversely to a vertical plane parallel to the overstroke direction;

wherein the switching module includes a shoulder adjacent the stop, the shoulder being separated from the stop by a step, the shoulder being configured to receive the blocking member when the blocking member is offset in the sideways direction when the blocking member runs over the step during the overstroke inward motion; and wherein the switching module further includes an opening deflection bevel and a return region, the opening deflection bevel being configured to be engaged by the beveled deflection part to deflect the blocking member vertically transversely to the overstroke direction into the return region during the overstroke inward motion.

2. The movement device for a drawer of claim 1, wherein:

the switching module further includes a guide track and a closing deflection bevel, the closing deflection bevel being configured to move the blocking member from the guide track back into a region of the stop during a closing motion of the drawer.

3. The movement device for a drawer of claim 2, wherein:

the switching module defines a cavity including a lead-in region configured to receive the switching element during the closing motion of the drawer.

4. The movement device for a drawer of claim 1, wherein:

the switching element includes a switching lever, the blocking member being attached to the switching lever, the switching element being held in a spring-prestressed manner with the blocking member against the stop, and the switching element being configured such that when the blocking member is offset in the sideways direction the prestressing is reduced or removed.

5. The movement device for a drawer of claim 4, wherein:

the switching element includes a deflection portion which is adjusted at a counter element when the switching element moves in order to move the switching element into a prestressed position.

6. The movement device for a drawer of claim 1, further comprising:

a pivot bearing on which the switching element is pivotably mounted.

7. The movement device for a drawer of claim 1, further comprising:

a closing mechanism configured to automatically close the drawer; and wherein the overstroke mechanism couples the push-to-open slide assembly with the closing mechanism.

8. The movement device for a drawer of claim 7, wherein:

the switching module is coupled directly or indirectly to the closing mechanism.

9. The movement device for a drawer of claim 1, wherein:

the push-to-open slide assembly further includes an actuating member and a spring, the switching element being carried by the actuating member, the actuating member being held prestressed directly or indirectly against the spring when the push-to-open slide assembly is in the closed position.

10. A method of moving a drawer from a closed position into an open or part-open position, comprising:

(a) holding the drawer in a closed position with a blocking member of a switching element abutting against a stop of a switching module; and (b) applying an overstroke movement in an overstroke direction to the drawer and thereby:

during the overstroke movement, lifting the switching element from the stop;

during the overstroke movement, moving the switching element over a step separating the stop from a recessed shoulder;

during the overstroke movement, offsetting the blocking member into the recessed shoulder in a sideways direction transversely to the overstroke direction and transversely to a vertical plane parallel to the overstroke direction when the switching element moves over the step; and wherein the offsetting further includes engaging a beveled deflection part of the blocking member with an opening deflection bevel of the switching module to deflect the blocking member vertically transversely to the overstroke direction into a return region of the switching module during the overstroke movement.

11. The method of claim 10, further comprising:

during a closing motion of the drawer, receiving the blocking member in a guide track of the switching module and engaging the blocking member with a closing deflection bevel of the switching module to move the blocking member from the guide track back into a region of the stop.

12. The method of claim 11, wherein:

during the closing motion of the drawer, the blocking member is received in a lead-in region of the switching module.

13. The method of claim 10, wherein:

during the step (a), holding the switching element in a spring-prestressed manner with the blocking member against the stop; and during step (b), reducing or removing the prestressing when offsetting the blocking member transversely to the overstroke direction.

14. The method of claim 10, further comprising:

pivoting the switching element on a pivot bearing.

15. The method of claim 10, further comprising:

during step (a), biasing the drawer toward the open position with a spring.

* * * * *